United States Patent [19]

Deutsch et al.

[11] 4,085,644

[45] Apr. 25, 1978

[54] POLYPHONIC TONE SYNTHESIZER

[75] Inventors: Ralph Deutsch; Leslie J. Deutsch, both of Sherman Oaks, Calif.

[73] Assignee: Deutsch Research Laboratories, Ltd., Los Angeles, Calif.

[21] Appl. No.: 603,776

[22] Filed: Aug. 11, 1975

[51] Int. Cl.[2] ..... G10H 1/00; G10F 1/00

[52] U.S. Cl. ..... 84/1.01; 84/1.03

[58] Field of Search ..... 84/1.01, 1.03, 1.11, 84/1.17, 1.19

[56] References Cited

U.S. PATENT DOCUMENTS

| | | | |
|---|---|---|---|
| 3,515,792 | 6/1970 | Deutsch | 84/1.25 X |
| 3,733,593 | 5/1973 | Moinar | 84/1.01 |
| 3,809,786 | 5/1974 | Deutsch | 84/1.01 |
| 3,809,788 | 5/1974 | Deutsch | 84/1.03 |
| 3,894,463 | 7/1975 | Rocheleau | 84/1.11 |

*Primary Examiner*—Edith S. Jackmon

*Attorney, Agent, or Firm*—Ralph Deutsch

[57] ABSTRACT

Musical notes are produced polyphonically in a tone synthesizer or like musical instrument by computing a master data set, transferring data set to buffer memories, and repetitively converting in real time contents of memories to notes. The master data set is created repetitively and independently of tone generation by computing a generalized Fourier algorithm using stored sets of generalized Fourier coefficients. Computations limit tones to audible frequencies, occur at intervals short compared to musical tone periods, and circuitry is included to provide time-varying modulations of the synthesized tonal structure. Synchronizing signals included in the buffer memories provide smooth transition between the master system logic clock and asynchronous tone conversion clocks. A time shared digital-to-analog converter transforms the buffer memory outputs to individual tone channels and provides attack, decay, sustain, release and other amplitude modulation effects.

36 Claims, 16 Drawing Figures

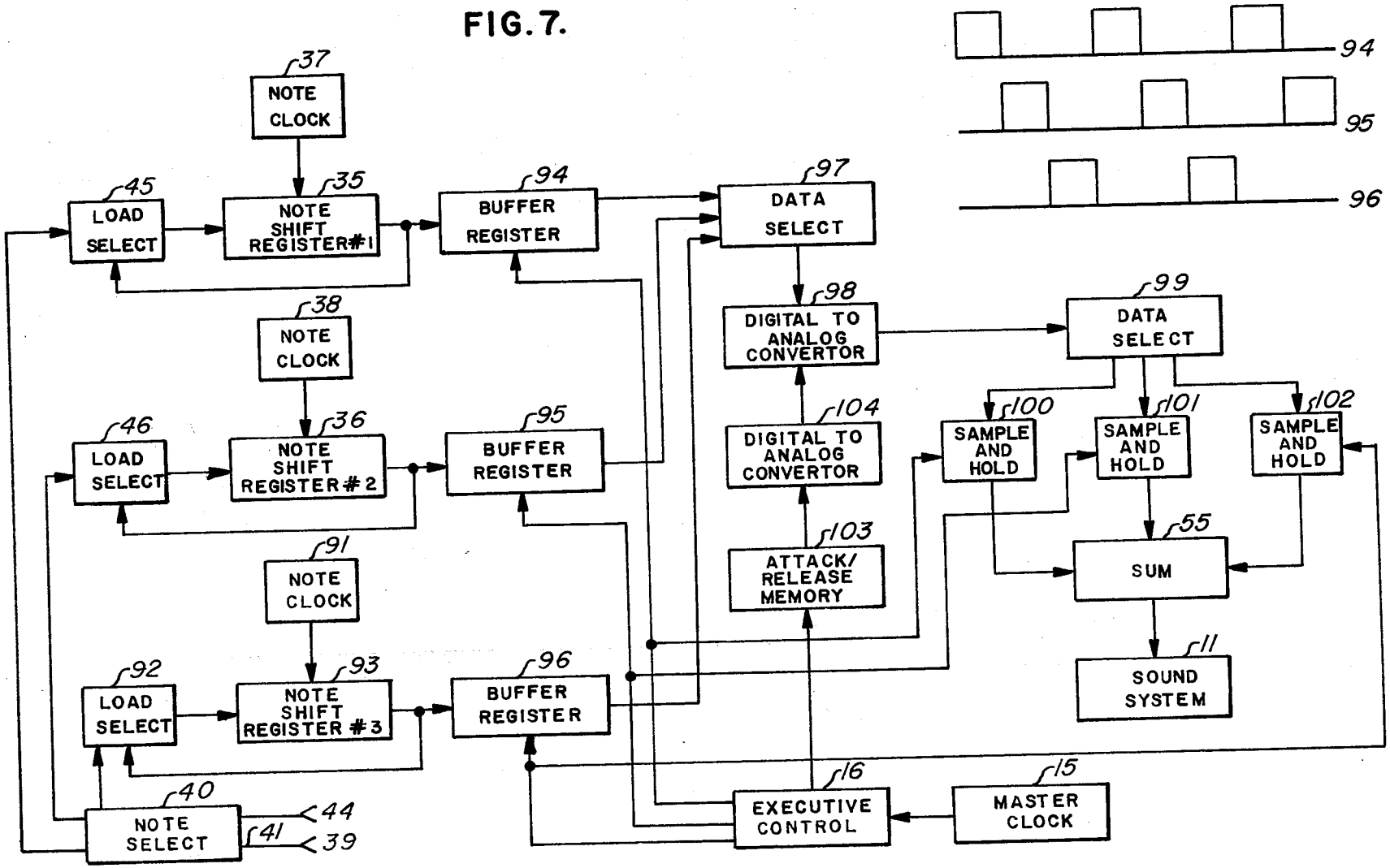
FIG. 7a
94
95
96
FIG. 7.
37
NOTE CLOCK
35
NOTE SHIFT REGISTER #1
45
LOAD SELECT
94
BUFFER REGISTER
38
NOTE CLOCK
36
NOTE SHIFT REGISTER #2
46
LOAD SELECT
95
BUFFER REGISTER
91
NOTE CLOCK
93
NOTE SHIFT REGISTER #3
92
LOAD SELECT
96
BUFFER REGISTER
44
39
41
40
NOTE SELECT
97
DATA SELECT
98
DIGITAL TO ANALOG CONVERTOR
104
DIGITAL TO ANALOG CONVERTOR
103
ATTACK/ RELEASE MEMORY
16
EXECUTIVE CONTROL
15
MASTER CLOCK
99
DATA SELECT
100
SAMPLE AND HOLD
101
SAMPLE AND HOLD
102
SAMPLE AND HOLD
55
SUM
11
SOUND SYSTEM

POLYPHONIC TONE SYNTHESIZER

BACKGROUND OF THE INVENTION

1. Field of the Invention

The present invention relates to a polyphonic musical instrument wherein tones are produced by computing a master data set, transferring the data to buffer memories, and converting buffer memory contents to musical sounds.

2. Description of the Prior Art

The advantages of digital waveshape generation in an electronic musical instrument are outlined in U.S. Pat. No. 3,515,792 and U.S. Pat. No. 3,809,786. Such advantages include a. realistic simulation of organ tones and other musical sounds such as piano, flute, bells, plucked strings;
b. production of the same waveshape, and hence tonal quality, regardless of which note or octave is being played;
c. simplified implementation of both foundation and mutation stops;
d. controlled selection of the attack and release characteristics of the produced musical notes;
e. all electronic operation; and
f. ease of construction using batch fabricated, digital microelectronic techniques.

In the organ described in U.S. Pat. No. 3,515,792, musical notes are produced by storing a digital representation of a waveshape characteristic, e.g. of an organ pipe tone, and repetitively reading out this stored waveshape at a selectable clock rate determining the fundamental frequency of the produced note. Stored in the waveshape memory are the actual amplitude values at a plurality of sample points. A frequency synthesizer produces a clock signal at a rate determined by the note selected on the organ keyboard or pedals. The stored amplitudes or amplitude increments are read out of the memory repetitively at the selected clock rate (which differs for each note) to generate the selected musical tone. Attack and decay is provided by programmed division, or division and subtraction, of the read out amplitude or increment values.

In the organ described in U.S. Pat. No. 3,809,786, musical notes are produced by computing the amplitudes at successive sample points of a complex waveshape and converting these amplitudes to notes as the computations are carried out. A discrete Fourier algorithm is implemented to compute each amplitude from a stored set of harmonic coefficients $C_n$ and a selected frequency number R, generally a non-integer, establishing the waveshape period. The computations, preferably digital, occur at regular time intervals $t$ independent of the waveshape period. At each interval $t$ the number R is added to the contents of a harmonic interval adder to specify the waveshape sample point $q$R, where $q = 1,2,3, \ldots$ For each point $q$R, W individual harmonic component values $C_n \sin(\pi nq R/W)$ are calculated, where $n = 1,2,3, \ldots, W$. These values are algebraically summed to obtain the instantaneous waveshape amplitude, which is supplied to a digital-to-analog converter and a sound system for reproduction of the generated musical note. Attack, decay and other note amplitude modulation effects are obtained by programmatically scaling the harmonic coefficients. In a polyphonic musical instrument system, time sharing and multiplexing is used to calculate separately the sample point amplitudes for each selected note, these amplitudes being combined by summation to produce the desired ensemble of musical sound.

The DIGITAL ORGAN described in U.S. Pat. No. 3,515,792 is not readily adaptable to modern musical instruments of the synthesizer variety wherein the tonal characteristics of a note must be capable of smooth continuous time variations. The waveshape stored in memory is a rigid representation of a prespecified tonal structure. Expensive digital filters are required to modify the harmonic structure of the stored waveshapes. Another serious drawback inherent in the use of stored waveshapes is the need for high system logic clock frequencies in a time-shared implementation of a polyphonic system. Tone synthesizers require tones corresponding to about 32 harmonics. At $C_7$, the 32'nd harmonic yields a frequency of $2093 \times 32 = 67$Khz; far above the audible range. The effective single channel clock frequency required to read such a waveshape at $C_7$ is $2 \times 67 = 134$Khz. A time shared 12 note polyphonic system that operates by multiplexing a single waveshape memory would require a minimum system logic clock of 1.6Mhz.

The COMPUTER ORGAN described in U.S. Pat. No. 3,809,786 overcomes many of the modern tonal musical problems caused by the inflexible waveshape in memory characteristics of the Digital Organ. The Computer Organ has a very severe requirement for fast system logic clocks. For a single channel generating a 32nd harmonic tone at $C_7$, the system logic clock must operate at a frequency of 4.29Mhz. A timed shared 12 note polyphonic system using a single computation channel requires a minimum system logic clock of 51.43Mhz. If harmonic limiting is used with the Computor Organ as described in U.S. Pat. No. 3,809,789, then for a maximum frequency of 20.9Khz (tenth harmonic of $C_7$), a single channel system requires a clock at 1.34Mhz and a 12 note polyphonic system requires a minimum system logic clock of 16.1Mhz. Further reduction of the system clock frequency can be accomplished by using additional circuitry as described in U.S. Pat. No. 3,809,788.

An object of the present invention is to provide a polyphonic electronic musical instrument wherein time varying waveshape synthesis is accomplished in a manner totally different from that known in the prior art, yet exhibiting all the above listed advantages of digital waveshape generation while using clock speeds compatible with economical batch fabricated digital microelectronic devices.

Other objects and features of the invention will become apparent in conjunction with the following descriptions and drawings.

SUMMARY OF THE INVENTION

The foregoing objective is achieved by providing a polyphonic electronic musical instrument wherein a computation cycle and a data transfer cycle are repetitively and independently implemented to provide data which is converted to musical notes. During the computation cycle a master data set is created by implementing a discrete Fourier algorithm using a stored set of harmonic coefficients which characterize the basic resultant musical tone. The computations are carried out at a fast rate nonsynchronous with any musical frequency. Provision is made for time varying the amplitudes of the computational orthogonal functions so that the musical effect of sliding formant filters is generated. Preferably, the harmonic coefficients and the orthogonal functions are stored in digital form, and the computations are carried out digitally. At the end of the computation cycle a master data set has been created and is temporarily stored in a data register.

Following a computation cycle, a loading cycle is initiated which transfers the master data set to a collection of read-write memories. The transfer for each memory is initiated by detection of a synchronizing bit and is timed by a clock which is asynchronous with the main system logic clock and has a frequency of Pf, where $f$ is the frequency of a particular note assigned to a memory and P is two times the maximum number of harmonics in the musical waveshape. The transfer cycle is completed when all of the memories have been loaded, at which time a new computation cycle is initiated. Tone generation continues uninterrupted during computation and load cycles.

A time shared digital-to-analog converter transforms the output data from the read-write memories to analog voltages assigned to individual tone channels. The digital-to-analog converter is time sequenced with each memory output data conversion to provide attack, decay, sustain, release, and other amplitude modulation effects.

BRIEF DESCRIPTION OF THE DRAWINGS

A detailed description of the invention will be made with reference to the accompanying drawings wherein like numerals designate like components in the several figures.

FIG. 7 is a block diagram of polyphonic tone synthesizer illustrating transfer from asynchronous to synchronous clocks and time shared digital-to-analog conversion.

FIG. 7*a* is a diagram of timing sequence for time shared digital-to-analog conversion.

DESCRIPTION OF THE PREFERRED EMBODIMENT

The following detailed description is of the best presently contemplated modes of carrying out the invention. This description is not to be taken in a limiting sense, but is made merely for the purpose of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

Figure 1:
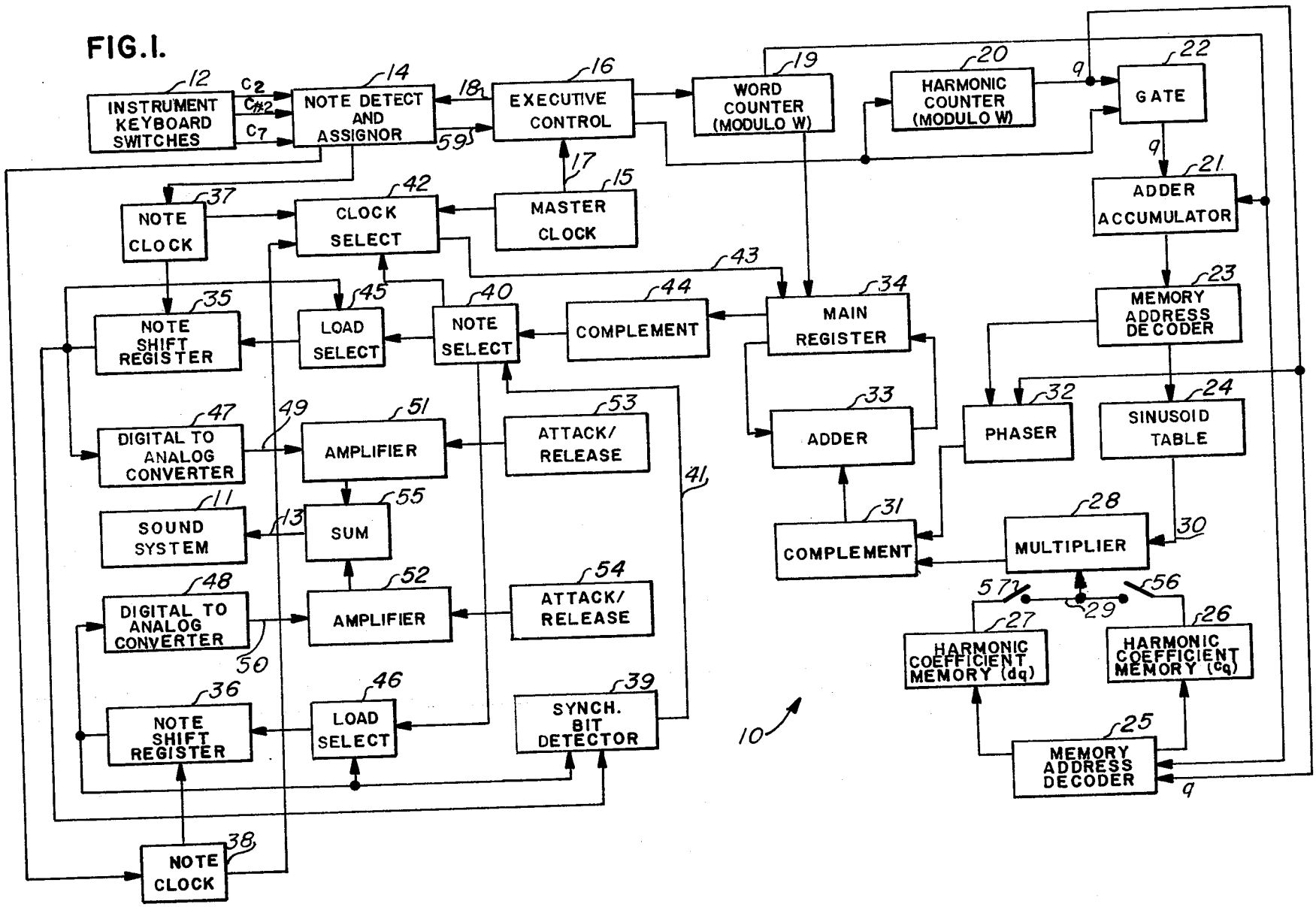
FIG. 1 is a block diagram which illustrates the computation cycle and load cycle of the present invention.
Figure 2:
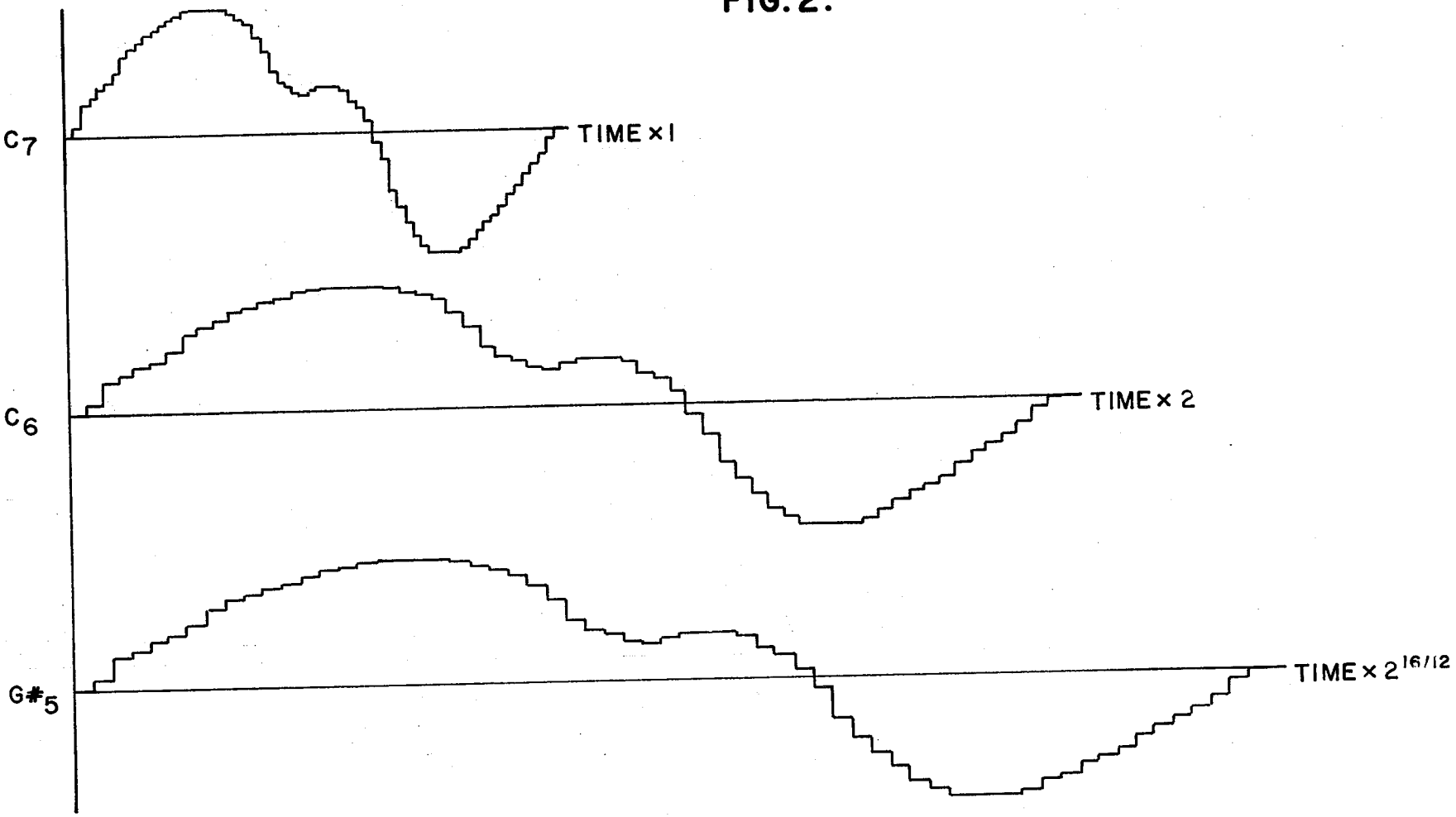
FIG. 2 shows typical musical waveshapes generated by the musical instrument of FIG. 1.

The polyphonic tone synthesizer 10 of FIG. 1 operates to produce via a sound system 11 a musical note selected by actuating a switch associated with instrument keyboard switches 12. FIG. 2 illustrates typical musical waveshapes supplied to the sound system 11 via a line 13 when the instrument keyboard switch associated with the musical note $C_7$, $C_6$ or $G\#_5$ respectively is actuated. As described below, each such waveshape is generated by first computing a master data set. The master data set is then transformed to the time domain (data amplitudes become a function of time) and finally is stretched in time so that its fundamental period (i.e. first harmonic period) corresponds to the actuated switch on the instrument keyboard 12.

It is well known that a musical sound characteristic of a particular instrument includes sinusoidal components of the fundamental and other generally harmonically related frequencies. The relative amplitudes of these components determine the tonal quality of the sound independent of the relative phase of the individual components.

A musical signal reproduced by a sound system 11 having an amplifier and speaker generally consists of an analog voltage having a waveshape (i.e. voltage as a function of time) which is a superposition or composite of the harmonic components of the corresponding sound. Such a complex waveshape may be described mathematically in terms of its harmonic components by the wellknown Fourier series equation for a periodic waveshape. The circuitry of 10 of FIG. 1 operates by first synthesizing a master data set computed by the following discrete Fourier series $$Z_N = \sum_{q=1}^{M} c_q \sin\left(2\pi \frac{Nq}{2M}\right) + \sum_{q=1}^{M} d_q \sin\left(2\pi \frac{Nq}{2M}\right) \qquad \text{(Equation 1)}$$

where N = 1,2, . . . ,2W is the number of a master data set word, $q$ = 1,2, . . . ,M is the harmonic number, M = W is the number of harmonics used to synthesize the master data set, $c_q$ are the harmonic coefficients for tone No. 1, and $d_q$ are the harmonic coefficients for tone No. 2. $q$ is sometimes called the order of the harmonic component. While the invention is illustrated for combination of two tones or "stops," the extension to any plurality of tones should be apparent to those skilled in the art. The number of harmonics, M, is a design choice, however the use of 32 harmonics (M = 32) is satisfactory for synthesizing the "bright" tonal sounds of a musical tone synthesizer. M can be a number less than or equal to W · W=N/2 is the maximum number of harmonics possible for a master data set having N words.

After the master data set has been computed, the circuitry 10 of FIG. 1 operates by stretching such data to correspond to musical notes actuated on the instrument keyboard switches 12.

Whenever a switch is actuated on the instrument keyboard switches 12, its actuation is detected by the note detect and assignor 14. The detection of an actuated key causes the assigning of a temporary memory in 14 containing data that identifies which particular key switch has been actuated. The note detect and assignor 14 transmits via line 59 to executive control 16 the information that a key has been detected as having been actuated on the instrument keyboard switches 12.

Circuitry suitable to implement the note detect and assignor are known in the art and one such system is described in U.S. Pat. No. 3,610,799 entitled Multiplexing System for Selection of Notes and Voices in an Electronic Musical Instrument.

The logic timing for the circuitry of FIG. 1 is controlled by the master clock 15. One such control line 17 is shown leading to executive control 16. A fairly wide range of frequencies can be used for the master clock 15; however advantageously a design choice is 1.1352Mhz.

The executive control 16 transmits control signals to several of the logic blocks to synchronously time various logic functions. Line 18 is one such line which transmits logic control signals from executive control 16 to note detector and assignor 14. The operation of system 10 is described for binary numbers and negative values are obtained by conventional "2's complement".

The computation cycle is defined as a repetitive event whose function is to compute Equation 1. At the beginning of the computation cycle the word counter 19, the harmonic counter 20, and the adder-accumulator 21 are all initialized to their initial state. That is, each device is set so that it has a value of 1. Table I lists the contents of the system logic blocks that are used during the computation function. At time $t_1$ corresponding to the first bit time of the computation cycle the word counter 19 content is the number one. The harmonic counter 20 also has the number one. The number in 20 is transmitted via gate 22 to the adder-accumulator at time $t_1$. The memory address decoder 23 receives the number from the adder-accumulator 21 and causes the value sin $2\pi(1\times1)/W$ to be read out from the sinusoid table 24. For brevity, Table I uses the notation $$S_{Ng} = \sin\pi Nq/W \qquad \text{Equation (2)}$$

and the sine table address is abbreviated using the symbolic notation $$(N\times q)^d = \pi Nq/W \qquad \text{(Eq. 3)}$$

The memory address decoder 25 receives the number contained in word counter 19 to select either harmonic coefficient memory 26 or harmonic coefficient memory 27. The selection is accomplished by a modulo 32 counter connected to a bistable gate so either one or the other harmonic coefficient memories is addressed. In addition to selecting a harmonic coefficient memory, memory address decoder 25 also addresses the appropriate harmonic number corresponding to each bit time in the computation cycle as indicated in Table I.

TABLE I

| t | N | q | Nq | SA | HC | ADD | MR | MRC |
|---|---|---|---|---|---|---|---|---|
| 1 | 1 | 1 | 1 | (1×1) | $c_1$ | $c_1S_1$ | 1 | $c_1S_1$ |
| 2 | 2 | 1 | 1 | (2×1) | $c_1$ | $c_1S_2$ | 2 | $c_1S_2$ |
| ... | ... | ... | ... | ... | ... | ... | ... | ... |
| 32 | 32 | 1 | 32 | (32×1) | $c_1$ | $c_1S_{32}$ | 32 | $c_1S_{32}$ |
| 33 | 1 | 1 | 1 | (1×1) | $d_1$ | $d_1S_1$ | 1 | $(c_1+d_1)S_1$ |
| ... | ... | ... | ... | ... | ... | ... | ... | ... |
| 64 | 32 | 1 | 32 | (32×1) | $d_1$ | $d_1S_{32}$ | 32 | $(c_1+d_1)S_{32}$ |
| 65 | 1 | 2 | 2 | (1×2) | $c_2$ | $c_2S_2$ | 1 | $c_1S_1+c_2S_2+d_1S_1$ |
| ... | ... | ... | ... | ... | ... | ... | ... | ... |
| 96 | 32 | 2 | 64 | (32×2) | $c_2$ | $c_2S_{64}$ | 32 | $c_1S_{32}+c_2S_{64}+d_1S_{32}$ |
| 97 | 1 | 2 | 2 | (1×2) | $d_2$ | $d_2S_2$ | 1 | $c_1S_1+c_2S_2+d_1S_1+d_2S_2$ |
| ... | ... | ... | ... | ... | ... | ... | ... | ... |
| 128 | 32 | 2 | 64 | (32×2) | $d_2$ | $d_2S_{64}$ | 32 | $c_1S_{32}+c_2S_{64}+d_1S_{32}+c_2S_{64}$ |

where:
t: bit time in computation cycle
N: content of word counter 19
q: harmonic number; content of harmonic counter 20
Nq: content of adder-accumulator 21
SA: sine table address
HC: harmonic coefficient input to multiplier 28
ADD: input to adder 33
MR: current word address for input to main register
MRC: content of main register at address MR
(Nxq): $\pi$ Nq/W At time $t_1$, memory address decoder 25 causes the harmonic coefficient $c_1$ to be read from harmonic coefficient memory 26. The input signals to the multiplier 28 are $c_1$ on line 29 and $S_1$ on line 30. Therefore, the output of the multiplier is the numerical value $c_1S_1$.

The functions of the complementer 31 and the phaser 32 will be described below after the other principle actions have been described for the computation cycle. Until these two functions are described, the operation will be explained under the assumption that the complementer 31 does not complement any of the input numbers so that positive and negative numbers are transferred from complementer 31 to adder 33 with no change of algebraic sign.

Main register 34 is a read-write set of registers which advantageously may comprise an end-around shift register. The contents of the main register 34 are initialized to a zero value at the start of the computation cycle. At time $t_1$, the value $c_1S_1$ is placed into word address 1 of the main register.

At the second bit time $t_2$, word counter 19 is incremented to the value 2. The harmonic counter is maintained at the value of 1 and will retain this value during the first 32 bit times of the computation cycle. The adder-accumulator 21 receives the current value of $q$ from harmonic counter 20 at each bit time. Therefore at time $t_2$, adder-accumulator has the value $Nq=2$. The value $S_2$ corresponding to the address $(2\times1)$ is transferred from sinusoid table 24 to multiplier 28. Also at time $t_2$, the harmonic coefficient $C_1$ is read from harmonic coefficient memory 26. The output signal from the multiplier is the value $c_1S_2$ which is added to the initial zero value of word No. 2 in main register 34 so that the net result is that the value $c_1S_2$ is placed into the word position at time $t_2$.

The first subroutine of the computation cycle is iterated for 32 bit times. At the end of the first subroutine, the contents of main register 34 are the first 32 values indicated in Table I under the column heading MRC (main register content).

Time $t_{33}$ initiates the second subroutine of the computation cycle. At time $t_{33}$, word counter 19 returns to its initial value of one because this device is a counter (modulo W), and W has been selected to have the value 32. The recycling of word counter 19 is detected by memory address decoder 25. This detection causes the memory address decoder to address harmonic coefficient memory 27 for the next successive 32 bit times in the computation cycle. The recycling of the word counter 19 is also detected by adder-accumulator 21 to cause it to return to a zero value. Therefore at time $t_{33}$, adder-accumulator 21 receives the current value of one from harmonic counter 20. This value in turn causes value $S_1$ to appear on line 30. Simultaneously the harmonic coefficient $d_1$ appears on line 29. After multiplication, the value $d_1S_1$ is added to the first word in main register 34 to produce the current value $c_1S_1+d_1S_1$ as shown in the last column in Table I for bit time $t_{33}$.

The second subroutine of the computation cycle is iterated for 32 bit times. At the end of the second subroutine computation cycle the contents of the main register are indicated in Table I under the entries for bit times $t_{33}$ to $t_{64}$.

Time $t_{65}$ initiates the third subroutine of the computation cycle. At time $t_{65}$, word counter 19 once again returns to its initial value of one. The recycling of word counter 19 is detected by memory address decoder 25 which in turn causes it to address harmonic coefficient memory 26 for 32 successive bit times. At bit time $t_{65}$, harmonic counter 20 is advanced to the value $q=2$. It will retain this value for 64 successive bit times causing the harmonic coefficient $c_2$ to be addressed 32 consecutive times followed by addressing $d_2$ for the subsequent 32 consecutive bit times. At time $t_{65}$, adder-accumulator 21 receives the current value $q=2$ from harmonic counter 20. The value $c_2S_2$ will be added to the contents of word No. 1 in main register 34, which at this time will contain the value $c_1S_1+c_2S_2+d_1S_1$. The third subroutine of the computor cycle is iterated 32 bit times. At the end of the third subroutine, the contents of main register 34 are indicated in Table I for bit times $t_{65}$ to $t_{96}$.

The fourth subroutine is similar to the third subroutine with the harmonic coefficient $d_2$ replacing $c_2$ that was used in the third subroutine. Thus, at bit time $t_{97}$ the contents of word No. 1 in main register 34 is the value $$c_1S_1+c_2S_2+d_1S_1+d_2S_2.$$

The computation cycle proceeds with the various subroutines until the last 64 bit times have been completed for the value $q=32$ contained in harmonic counter 20. At the end of the computation cycle the values in each of the address numbers of main register 34 are the values given by Equation 1 where the subscript $N=1,2,\ldots,32$ corresponds to the main register address numbers.

It is not necessary to have 64 word numbers in main register 34 as indicated by Equation 1. Only one-half of these values need to be evaluated during the computation cycle because the remaining values can be immediately obtained by using the well-known odd symmetric characteristic property of the trigonometric sine function. Thus, the remaining values are obtained by the odd symmetric relation $$Z_N = -Z_{65-N} \qquad \text{(Equation 4)}$$

$$N = 33,34,\ldots,64.$$

The computation cycle requires a total of $32\times U\times 32$ bit times, where U is the number of harmonic coefficient sets that are used to synthesize the data for a complex musical tone. For the illustrative system of FIG. 1, $U=2$. The computation time interval is equal to a bit time. The sinusoid table 24 may comprise a read only memory storing values $\sin(\pi/16)\theta$, for $\theta=1,2,\ldots,64$. It is advantageous to implement multiplier 28 so that both the multiplier and the multiplicand are always positive numbers. Therefore, the preferred implementation is to have the sinusoid table only store the positive values for $\theta=1,2,\ldots,32$. When $33\leqq\theta\leqq64$, a "1" signal is sent to phaser 32 to denote that the sinusoid value read at that corresponding bit time has a negative value. If $0\leqq\theta\leqq32$, a "0" signal is sent. In addition to its task of permitting multiplier 28 to function with only positive input values, phaser 32 also performs the important task of minimizing the maximum value of the master data set. It is known that the ear is insensitive to the relative phase of the individual harmonics, in a musical tone. Therefore, the phase, or algebraic sign, of any of the individual harmonic components can be inverted in Equation 1 without changing the resultant sound generated by the polyphonic tone synthesizer 10 of FIG. 1. A table of 32 values of 1 and 0 are stored in phaser 32. These are addressed by the corresponding value of $q$ for each specific bit time in the computation cycle to create a phase control signal. While there is no unique optimum set of phase coefficients that will minimize the peak amplitude value for all possible complex musical waveshapes, the following set of values have been experimentally verified to produce satisfactory results 0,0,0,0,0,0,0,0,1,1,1,0,0,0,1,1,0,0,1,1,0,1,1,0,1,0,0,0,1,0,-
1,0,1,

Phaser 32 combines the $q$-addressed stored phase data with the quadrant data received from memory address decoder 23 in an exclusive-or gate to generate a control signal that is sent to complementer 31. In this fashion the positive product from multiplier 28 is either sent unmodified through complementer 31 to adder 33, or the product is effectively inverted in algebraic sign by a signal that causes the input value to be complemented by complementer 31. The term "complement" is used for the conventional binary process of 2's complement.

An alternative to storing the phase values in a table is to use wired digital logic to generate such values for each input value of the harmonic number $q$.

At the completion of the computation cycle, executive control 16 initiates the start of the data transfer cycle. During the data transfer cycle, the contents of main register 34 are transferred in a carefully controlled manner to note shift registers 35 and 36. While the description of the data transfer cycle is illustrated for two note shift registers, the extension to any multiplicity is apparent.

Each note shift register has its own separate bit position for a synchronizing bit. This bit position is always a "1" for a single word and is "0" for all other words. The synchronizing bit is used by various logic blocks to detect the initial phase state of the end-around note shift registers as described below. More generally the synchronizing may consist of a synchronizing time data word.

When a first key has first been actuated on the instrument keyboard switches 12, a note clock 37 is assigned by note detect and assignor 14. A preferred implementation is to use a VCO (Voltage Controlled Oscillator) for note clocks 37 and 38. For this embodiment of the invention, the note clocks are not locked with master clock 15 and are running asynchronously. Not detect and assignor 14 when it detects the closure of a keyboard switch transfers a control voltage, or detection signal, to each note clock which causes these clocks to operate at a rate of 64 times the fundamental frequency corresponding to the keys actuated on the instrument keyboard.

Note clocks 37 and 38 cause their respective note shift registers 35 and 36 to transfer data end-around at their individual clock rates. When the word containing the synchronizing bit is read from note shift register 35, its presence is detected by synchronizing bit detector 39. When a synchronizing bit is detected, a phase time is initiated and a phase time signal is sent to note select 40 which identifies the particular note shift register and serves to initiate the first subcycle of the data transfer cycle. One the first subcycle has been initiated, it cannot be terminated by the detection of another synchronizing bit by synchronizing bit detector 39; for example from note shift register 36.

At the start of the first subcycle of the data transfer cycle, note select 40 uses the information received via line 41 to cause the output signal on line 43 from clock select 42 to change from master clock 15 to the clock rate generated by note clock 37. The word contents of main register 34 are then transferred sequentially to complement 44. During data transfer from main register 34, adder 33 merely transfers data from one end of the register to the other without modifying the data. The first 32 words read from main register 34 are transferred unmodified by complementer 44 to note select 40. After the first 32 words are read from the master data set, main register 34 is reversed in direction for the second subcycle of the load cycle so that the remaining 32 words are read in the reversed word order 32,31,30, . . . ,1. The second time the contents of the main register are read during the second half of the load cycle, complementer 44 operates to transfer the complement (negative values) of each input data word. Note select 40 sends the data to load select 45. The load select logic blocks 45 and 46 either operate to load their associated note shift registers or to permit them to operate in an end-around mode when the corresponding data transfer subcycle has been completed. An up-down counter is advantageously used to control bi-directional reading of main register 34.

After note register 35 has been loaded with data transferred from the main register at the clock rate determined by note clock 37, the first subcycle of the data transfer cycle is completed. The second subcycle is initiated the next time that a synchronizing bit is detected by synchronizing bit detector 39 from the data being read from note shift register 36. The operation of the second subcycle is analogous to the first subcycle with note clock 38 now used for timing the transfer of data from main register 34.

At the conclusion of the data transfer cycle, executive control 16 may initiate a new computation cycle. While such new computation cycle is underway, data is being read independently from both note shift registers 35 and 36 under control of their individual note clocks 37 and 38. By the described means, the master data set computed and temporarily stored in main register 34, has now been stretched to correspond to a musical waveform at note frequencies corresponding to switches actuated on the keyboard.

The output data from each note shift register 35 and 36 is converted to an analog voltage by means of digital-to-analog converters 47 and 48. Typical musical waveshapes appearing on lines 49 and 50 are shown in FIG. 2. The musical waveshapes are amplified in amplifiers 51 and 52 and the desired attack/release envelope waveshapes are applied by means of the attack/release generators 53 and 54. The two signals from the two amplifiers are combined in the sum 55 and the resultant composite signal is sent to the sound system 11.

Any of the wide variety of known means for implementing attack/release envelope generators can be used for attack/release generators 53 and 54. A suitable means is described in U.S. Pat. No. 3,610,805 entitled Attack and Decay System for a Digital Electronic Organ.

The computation cycle and the data transfer cycle are independent of each other but are programmed to operate sequentially. During a computation cycle, the output musical tones are continuously generated and are not interrupted. Moreover, during the data transfer cycle, the individual tones are not interrupted so that the musical tones do not have any discontinuities if the harmonic coefficients have not been changed. If a control is opened such as either switch 56 or 57, the tone quality will change at the completion of next subsequent computation cycle and data transfer cycle. Switches 56 and 57 are commonly called "stops" or tone switches.

Figure 3:
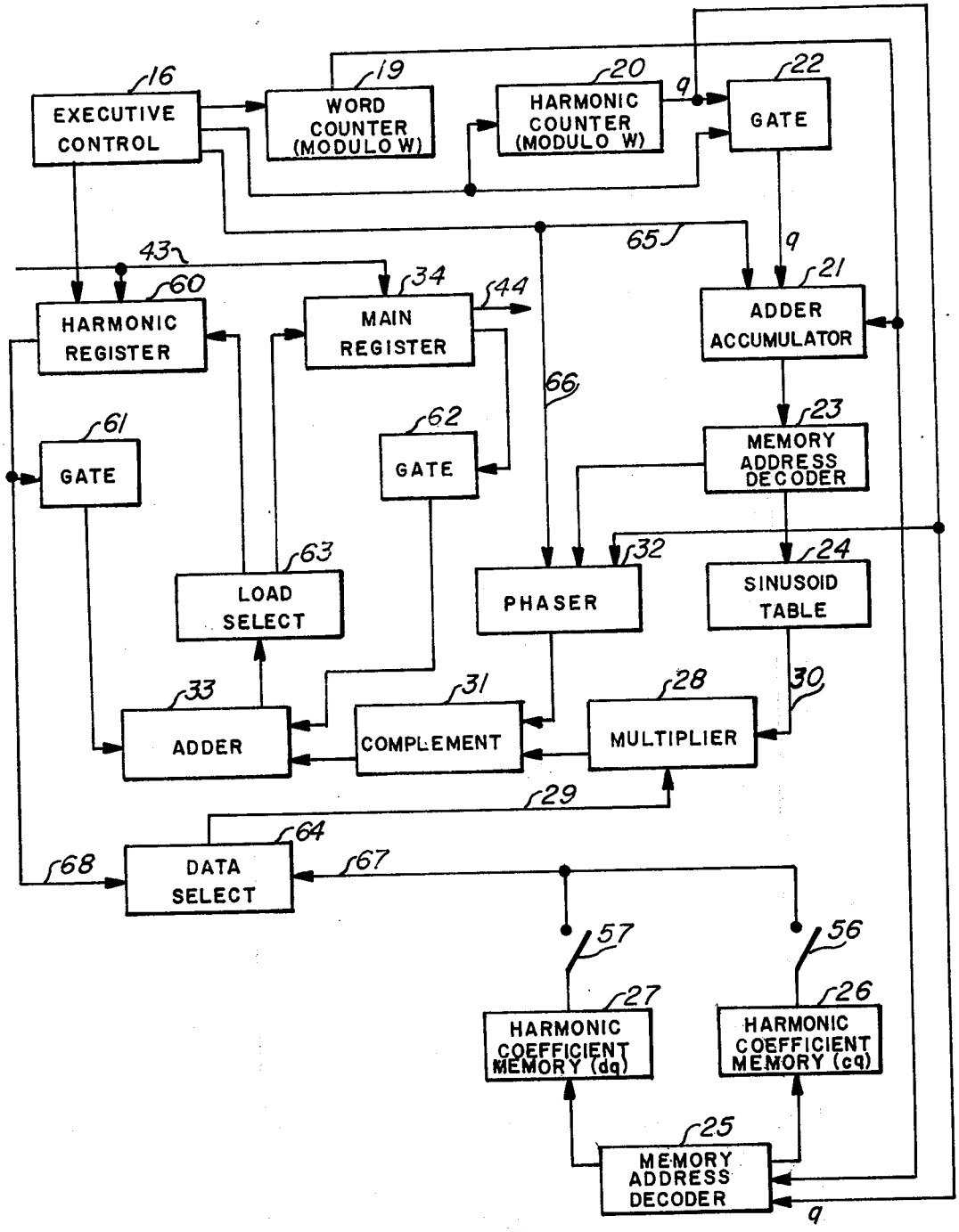
FIG. 3 is a block diagram illustrating a harmonic combination subcycle of a computation cycle.

An alternative system for synthesizing the master data set is shown in FIG. 3. A harmonic combination cycle is added before the start of each computation cycle. The harmonic combination cycle is initiated by executive control 16. The cycle is started by initiating word counter 19 and harmonic counter 20 each to a value of one. Adder-accumulator 21 receives a signal on line 65 from executive control 16. This signal remains constant during the entire harmonic combination cycle and causes adder-accumulator 23 to have a constant value of 32. Memory address decoder 23, therefore, will address the value $S_{16}$ from sinusoid table 24 at each bit time of the harmonic combination cycle. $S_{16}$ will generally be equal to one, or very nearly so depending upon the numerical accuracy of sinusoid table 24.

At the start of the harmonic combination cycle, the entire contents of harmonic register 60 are initialized to a zero value by a control signal generated and sent from executive control 16. During the harmonic combination cycle, phaser 32 receives a constant signal via line 66 from the executive control 16. The signal on line 66 causes the phaser to output the value "0" at each bit time. Thus, at each bit time complementer 31 will not complement any of the numerical values it receives from multiplier 28.

The harmonic combination cycle starts at the first bit time $h_1$. At time $h_1$, word counter 19 has the value 1 which causes memory address decoder 25 to address harmonic coefficient memory 26. Since harmonic counter 20 has the value 1 at time $h_1$, the harmonic coefficient $c_1$ will be read from harmonic coefficient memory 26 and sent to data select 64 if tone switch 56 is in the closed position. During the harmonic combination cycle, data select 64 allows data received on line 67 to be transferred to multiplier 28 and at the same time inhibits the transfer of data on line 68.

The input data to multiplier 28 at time $h_1$ is $c_1$ and $S_{16}$. During the harmonic combination cycle gate 62 inhibits any data from main register 34 from reaching adder 33, while gate 61 allows the data read from harmonic register 60 to reach adder 33. Therefore, at the first bit time $h_1$, the output of adder 33 will be the sum of $0c_1S_{16}$. Since $S_{16}$ is either equal to one, or very nearly so, the sum is very nearly $c_1$. Load select 63 allows the output from adder 33 to be loaded into a word position in harmonic register 60. Harmonic register 60 is a read-write set of registers which advantageously may comprise an end-around shift register.

For the first 32 bit times of the harmonic combination cycle, word counter 19 and harmonic counter 20 consecutively are incremented and have the values 1,2, . . . ,32. In this fashion, the contents of harmonic coefficient memory 26 are caused to be transferred to harmonic register 60.

The second subcycle of the harmonic combination cycle is initiated at time $h_{33}$ corresponding to bit time 33. At time $h_{33}$, word counter 19 is reset automatically to the value 1 because it is a counter modulo 32. Thus at time $h_{33}$, memory address decoder 25 detects the reset of word counter 19 and accordingly causes harmonic coefficient memory 27 to be addressed during the consecutive 32 bit times of the second subcycle of the harmonic combination cycle.

At time $h_{33}$, the harmonic coefficient $d_1$ will be transferred to multiplier 28 if switch 57 is closed. The two inputs to adder 33 will be $c_1$ (already transferred to harmonic register 60 during the first subcycle) and $d_1$. The value $c_1+d_1$ will then be transferred to harmonic register 60 through the control of load select 63. This combination process is iterated during the 32 bit times of the second subcycle of the harmonic combination cycle. The cycle concludes at time $h_{64}$ with the contents of harmonic register 60 being the sum of the harmonic coefficients contained in harmonic coefficient memories 26 and 27. Either, or both, sets of coefficients may be combined in harmonic register 60 depending upon the state of tone switches 56 and 57.

The modification of the harmonic combination cycle for any plurality of harmonic coefficient memories should be apparent to those skilled in the art. The harmonic combination cycle requires 32*g* bit times, where *g* is the number of harmonic coefficient memories.

When the harmonic combination cycle has been completed, executive control 16 starts a computation cycle. In addition to all the initialization signals previously described for the computation cycle, certain other signals are required when a harmonic combination cycle precedes the computation cycle with the system shown in FIG. 3. During the computation cycle, memory address decoder 23 and phaser 32 are commanded to their normal operation as previously described for the computation cycle. Data select 64 is now commanded by executive control 16 to transfer data received on line 68 to multiplier 28. Gate 61 is also commanded to inhibit data that would be sent to adder 33 from harmonic register 60 while gate 62 is commanded to transfer data to adder 23 as read from main register 34. Load select 63 is commanded by executive control 16 to transfer data from adder 33 to main register 34. These controls place the system shown in FIG. 3 into the same configuration for the computation cycle as shown in FIG. 1 and previously described with the exception that the data contained in harmonic register 60 is substituted as the input to multiplier 28 in place of the data read directly from harmonic coefficient memories 26 and 27.

The computation cycle for the system shown in FIG. 3 requires $32 \times 32 = 1024$ bit times and is independent of the plurality of harmonic coefficient memories. The harmonic combination time interval required for a harmonic combination cycle is 32 times the number of stops measured in time intervals of a bit time.

An apparent modification in the use of a harmonic combination cycle in conjunction with a computation cycle is after the first such harmonic combination cycle to omit such cycle before a computation cycle unless a change has been detected in the state of tone switches 56 and 57. The elimination of redundant computation cycles is advantageous when it is desirable to keep the computation cycle time as fast as possible consistent with the timing logic of the remainder of the polyphonic tone synthesizer system.

Figure 4C:
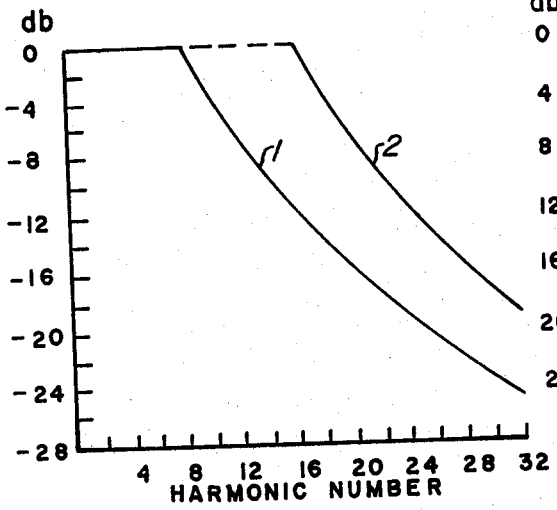
FIG. 4*c* illustrates the harmonic number-amplitude relation for an effective low-pass formant filter.
Figure 4D:
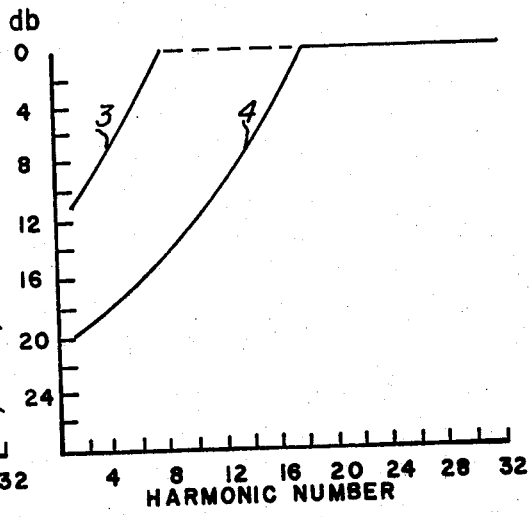
FIG.4*d* illustrates the harmonic number-amplitude relation for an effective high-pass formant filter.
Figure 4A:
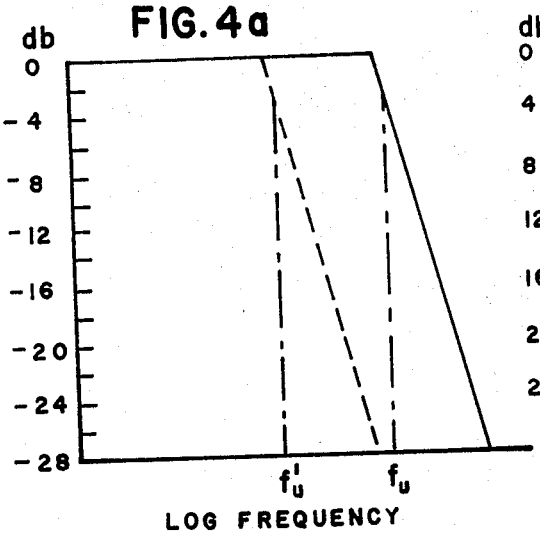
FIG. 4*a* illustrates the frequency-amplitude response of a conventional analog low-pass filter.
Figure 4B:
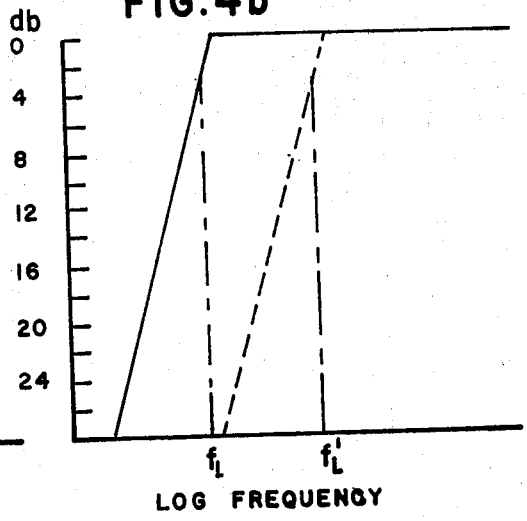
FIG. 4*b* illustrates the frequency-amplitude response of a conventional analog high-pass filter.

FIG. 4*a* illustrates a conventional straight line approximation for the amplitude-frequency response of a low-pass filter having a slope of −12db per octave and a cut-off frequency $f_u$ defined by the −3db point. A sliding formant filter is a filter such that the cut-off frequency moves from $f_u$ to another frequency $f_u'$ in some prescribed manner. The change in the cut-off frequency may be made variable by means of a manually operated control or it may be varied automatically as a predetermined function of time. Experimentally, suitable time functions have been found to include a cut-off frequency change linear with time between predetermined limits as well as to cause the change to be proportional to the attack/release envelope shape of the generated tones. FIG. 4*b* illustrates a conventional straight line approximation for a high-pass filter having a slope of 12db per octave and a cut-off frequency $f_L$ defined by the −3db point. A sliding formant filter of the high pass type is one in which the cut-off frequency $f_L$ moves to $f_L'$ in some prescribed manner. Sliding formant filters can be either of the low-pass type, the high-pass type, or a combination of both.

FIG. 4*c* illustrates an effective low-pass filter obtained by attenuating the harmonic coefficients. Curve 1 illustrates a cut-off starting at harmonic number 8 while curve 2 illustrates a cut-off starting at harmonic number 16. FIG. 4*d* illustrates an effective high-pass filter with curve 3 illustrating a cut-off at harmonic number 8 and curve 4 illustrating a cut-off at harmonic number 17.

Figure 5:
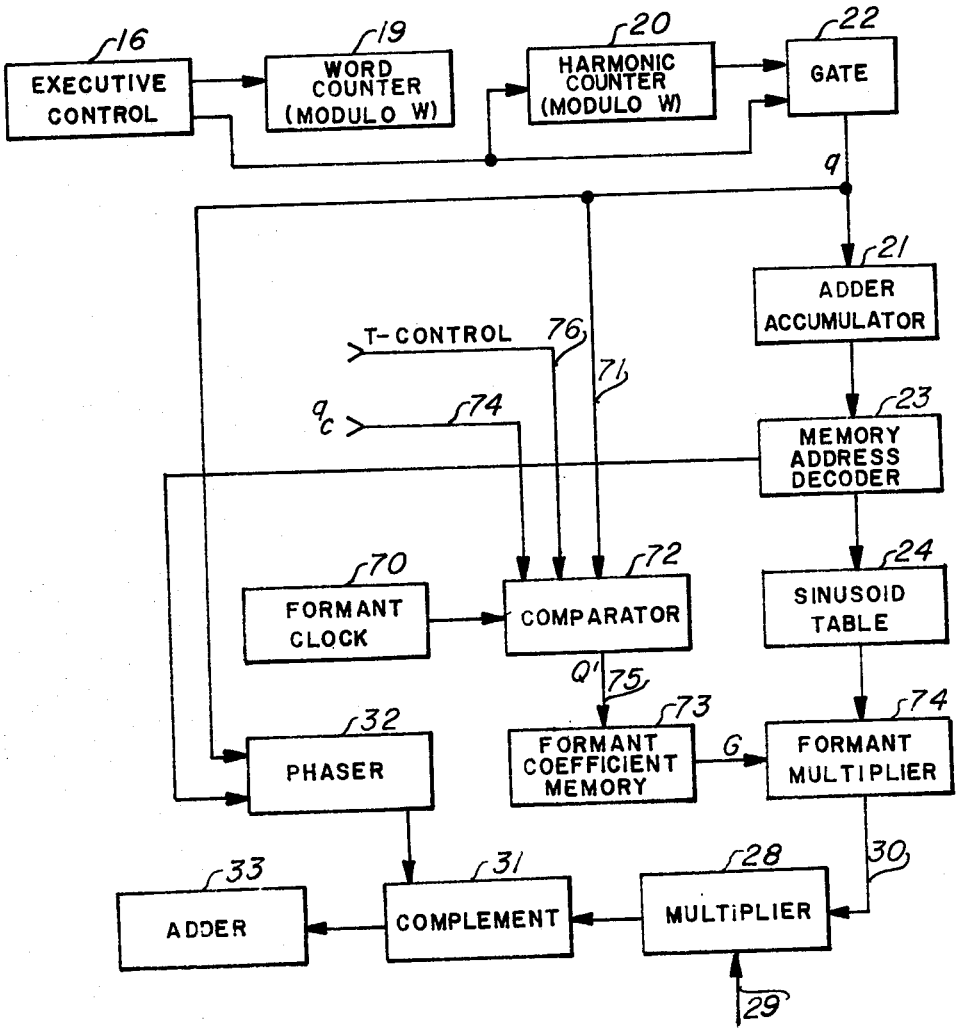
FIG. 5 is a block diagram showing means for obtaining sliding formant filters.

FIG. 5 shows the insertion of a subsystem into system 10 of FIG. 1 to provide a means for implementing an effective sliding formant filter in the polyphonic tone synthesizer. The input to comparator 72 via line 71 is the current value *q* of the harmonic number in the computation cycle. A value $q_c$ is an input to comparator 72 via line 74. $q_c$ is the harmonic number that determines the effective cut-off for the effective low-pass filter. Formant clock 70 provides some prescribed timing means for providing a time varying value $u$ as an input to comparator 72. Comparator 72 at each bit time of the computation cycle compares the value of $q+u$ to the value of $q_c$. If $q+u$ is less than or equal to $q_c$, comparator 72 transmits the value $Q'=1$ via line 75 to formant coefficient memory 73. If comparator 72 makes a comparison at some bit time and finds that $q+u$ is greater than the value of $q_c$, the value $Q'=q+u-q_c$ is transmitted as an address to formant coefficient memory 73. An attenuation factor, or formant coefficient, G is addressed from formant coefficient memory 73 in accordance with the input value of Q'. Formant multiplier 74 multiplies the current value addressed from sinusoid table 24 with the value G addressed from formant coefficient memory 73. The product generated by formant multiplier 74 is transmitted via line 30 to multiplier 28.

The output signal value $u$ from formant clock 70 can be either increasing or decreasing as a function of time. Table II lists suitable values for formant coefficient memory 73. The gain factors G are stored and addressed by the listed values of Q'. The columns labeled db are the equivalent attenuation values in decibels corresponding to the gain factors G. Advantageously formant coefficient memory 73 may comprise a read only memory storing values of Q'.

TABLE II

| Q' | db | G | Q' | db | G |
|---|---|---|---|---|---|
| 1 | 0 | 1.00000 | 17 | −19.08 | 0.11111 |
| 2 | −2.05 | 0.79012 | 18 | −19.79 | 0.10240 |
| 3 | −3.88 | 0.64000 | 19 | −20.48 | 0.09467 |
| 4 | 5.53 | 0.52892 | 20 | −21.13 | 0.08779 |
| 5 | −7.04 | 0.44444 | 21 | −21.76 | 0.08163 |
| 6 | −8.43 | 0.37870 | 22 | ×22.37 | 0.07610 |
| 7 | −9.72 | 0.32653 | 23 | −22.96 | 0.07111 |
| 8 | −10.92 | 0.28444 | 24 | −23.53 | 0.06660 |
| 9 | −12.04 | 0.25000 | 25 | −24.08 | 0.06250 |
| 10 | −13.09 | 0.22145 | 26 | −24.62 | 0.05877 |
| 11 | −14.09 | 0.19753 | 27 | −25.14 | 0.05536 |
| 12 | −15.02 | 0.17729 | 28 | −25.64 | 0.05224 |
| 13 | −15.92 | 0.16000 | 29 | −26.13 | 0.04938 |
| 14 | −16.77 | 0.14512 | 30 | −26.60 | 0.04675 |
| 15 | −17.57 | 0.13223 | 31 | −27.07 | 0.04432 |
| 16 | −18.35 | 0.12098 | 32 | −27.52 | 0.04208 |

The T-control signal transmitted via line 76 as an input to comparator 72 determines if the synthetic sliding formant filter is to function in the low-pass or high-pass mode. If T-control is a "1," then the effective sliding formant filter functions as previously described are in the low-pass mode. If T-control is "0," then the effective sliding formant filter functions as described in the following paragraph in the high-pass mode.

When the T-control signal is "0," comparator 72 at each bit time of the computation cycle compares the value of $q+u$ to the value of $q_c$. If $q+u$ is greater than or equal to the value of $q_c$, comparator 72 transmits the value $Q'=1$ via line 75 to formant coefficient memory 73. If comparator 72 makes a comparison at some bit time and finds that $q+u$ is less than the value of $q_c$, the value $Q'=q_c-(q+u)$ is transmitted to formant coefficient memory 73.

It is an apparent modification to use two comparators so that a combination of effective sliding formant filters can be implemented simultaneously wherein each such comparator is dedicated to a high-pass and to a low-pass mode. A single comparator can also be implemented to simultaneously perform the value comparisons for the high-pass and low-pass modes. Other values of Q' can readily be programmed into formant memory 73 to provide other filter shapes than the simple low-pass and high-pass filter shapes.

Instead of using a table of formant coefficients it is an obvious modification to use circuitry of calculating suitable values in response to the output signal from a comparator. For example, values of G in Table II were computed from the relation $$G = \exp\{0.1151 \times 40\log_{10}(8/(7+n))\}.$$

The polyphonic tone synthesizer 10 shown in FIG. 1 was previously described for synthesizing tones having 32 harmonics. This number of harmonics leads to a maximum frequency of 2093 × 32 = 66.976Khz when the top musical key $C_7$ is actuated on the instrument keyboard. The human ear cannot detect the presence of such a high frequency. It is desirable to limit the highest generated overtone frequency to a value which is consistent with the human hearing ability so that certain system simplifications can be incorporated as described below.

Table III lists the maximum overtone frequency corresponding to given harmonics for the keyboard range. The MAX. FREQ. listed in column 4 was calculated using the restriction that no overtone frequency is to exceed 15Khz. Column 3 lists the maximum harmonic number for each note that is consistent with the specified maximum of 15Khz. All notes from $C_2$ to A#4 remain within the maximum for the full content of 32 harmonics. Above A#4, the harmonic content must be restricted as shown to remain within the maximum frequency. In column 6 is shown the maximum frequencies corresponding to using 21 harmonics in the octave range $C_5$ to $B_5$ and using 10 harmonics in the extended octave range $C_6$ to $C_7$.

TABLE III

| Note | Frequency | Harmonic | Max. Freq. | Harmonic | Max. Freq. |
|---|---|---|---|---|---|
| C2 | 65.4 | 32 | 2093 | | |
| C3 | 130.8 | 32 | 4186 | | |
| C4 | 277.2 | 32 | 8870 | | |
| A4 | 440.0 | 32 | 14,080 | | |
| A#4 | 466.2 | 32 | 14,917 | | |
| B4 | 493.9 | 30 | 14,817 | 32 | 15,804 |
| C5 | 523.3 | 28 | 14,651 | 21 | 10,988 |
| C#5 | 554.4 | 26 | 14,414 | 21 | 11,642 |
| D5 | 587.3 | 25 | 14,683 | 21 | 12,334 |
| D#5 | 622.3 | 24 | 14,934 | 21 | 13,067 |
| E5 | 659.3 | 22 | 14,504 | 21 | 13,844 |
| F5 | 698.5 | 21 | 14,660 | 21 | 14,668 |
| F#5 | 740.0 | 20 | 14,800 | 21 | 15,540 |
| G5 | 784.0 | 19 | 14,896 | 21 | 16,464 |
| G#5 | 830.6 | 18 | 14,951 | 21 | 17,443 |
| A5 | 880.0 | 17 | 14,956 | 21 | 18,480 |
| A#5 | 932.3 | 16 | 14,917 | 21 | 19,579 |
| B5 | 987.8 | 15 | 14,817 | 21 | 20,743 |
| C6 | 1046.5 | 14 | 14,651 | 10 | 10,465 |
| C#6 | 1108.7 | 13 | 14,414 | 10 | 11,088 |
| D6 | 1174.7 | 12 | 14,096 | 10 | 11,747 |
| D#6 | 1244.5 | 12 | 14,934 | 10 | 12,445 |
| E6 | 1318.5 | 11 | 14,504 | 10 | 13,185 |
| F6 | 1396.9 | 10 | 13,969 | 10 | 13,969 |
| F#6 | 1480.0 | 10 | 14,800 | 10 | 14,800 |
| G6 | 1568.0 | 9 | 14,112 | 10 | 15,680 |
| G#6 | 1661.2 | 9 | 14,951 | 10 | 16,612 |
| A6 | 1760.0 | 8 | 14,080 | 10 | 17,600 |
| A#6 | 1864.7 | 8 | 14,917 | 10 | 18,647 |
| B6 | 1975.5 | 7 | 13,829 | 10 | 19,755 |
| C7 | 2093.0 | 7 | 14,651 | 10 | 20,930 |

Figure 6:
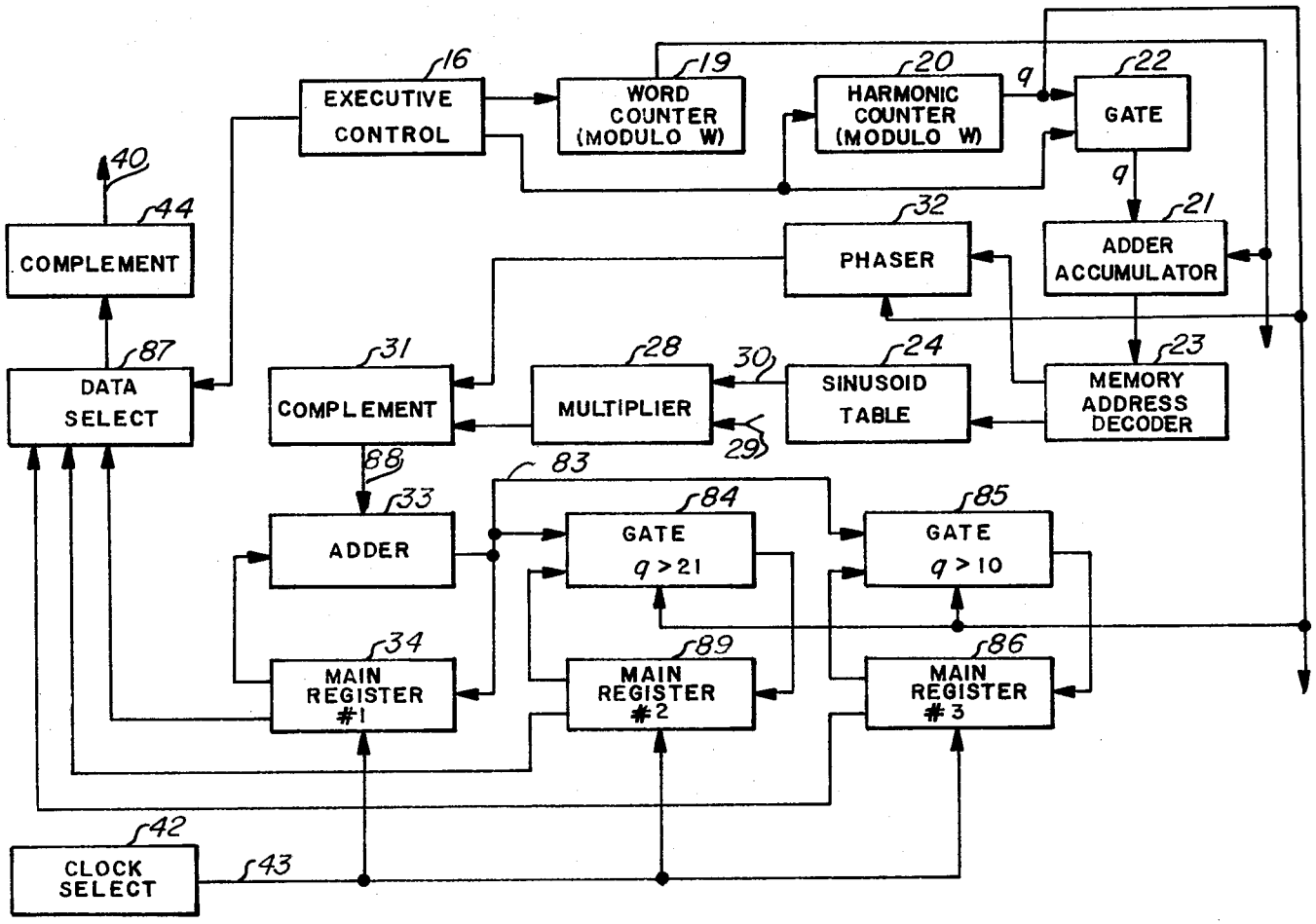
FIG. 6 is a block diagram of a polyphonic tone synthesizer showing means for harmonic limiting during computation cycle.

FIG. 6 shows a subsystem combined with system 10 of FIG. 1 which implements a harmonic limiting function as illustrated by the entries in columns 5 and 6 of Table III. The output signal from complementer 31 is transmitted via line 88 to adder 33. Adder 33 in conjunction with main register #1 34 operates in a manner previously described with reference to FIG. 1. For values of the harmonic number $q$ less than 11, gate 85 causes main register #3 86 to load the same data as that being loaded into main register #1 34. However, for values of $q$ greater than 10, gate 85 inhibits the data received on line 83 from adder 33 from reaching main register #3 86. For these values of $q$, gate 85 causes the contents of main register #3 86 to shift end-around with no change. Gate 84 in conjunction with main register #2 operates analogous to the combination of gate 85 and main register #3. The difference being that gate 84 inhibits data received on line 83 for values of harmonic number $q$ that exceed 21.

The three main registers 34, 89, and 86 are each timed by a common clock signal received via line 43 from clock select 42. The output signals from main registers 34, 85, 86 are transmitted to data select 87. Executive control 16 causes data select 87 to transfer data from a main shift register corresponding to the note assigned to a particular note shift register. Thus, if a note shift register has been assigned a note clock corresponding to a keyboard switch actuated in the range $C_2$ to $B_4$, the transfer is made from main register #1 34 to the note shift register. If a note shift register has been assigned a note clock corresponding to a keyboard switch actuated in the range $C_5$ to $B_5$, then the transfer is made from main register #2 89 to the note shift register. Similarly, notes in the range $C_6$ to $C_7$ cause a data transfer to be made from main shift register #3 86 to the assigned note shift register.

Harmonic limiting in the polyphonic tone synthesizer can readily be extended to any plurality of octave or note range divisions as represented by the plurality of main registers and gates. The plurality of such registers does not effect the number of bit times in the computation cycle which remains at the same value required for a system utilizing only a single main register without harmonic limiting.

FIG. 7 shows an alternative output subsystem for the polyphonic tone synthesizer system 10 as shown in FIG. 1 and previously described. It is an objective of the subsystem shown in FIG. 7 to employ time sharing of common circuit elements to materially reduce the proliferation of repeated similar circuit elements as the plurality of note shift registers is increased. While FIG. 7 illustrates a time shared output subsystem for three note shift registers corresponding to three simultaneously played notes on the keyboard, the extension to any plurality of note generators is apparent. The operation of FIG. 7 is described for a condition following any loading cycle after the initial such cycle. Each note shift register 35, 36, and 93 operates in a conventional end-around mode under control of their respective individual note clocks 37, 38, and 91. These clocks are usually asynchronous with respect to master clock 15. As a data word is shifted to the output of a note shift register it is transferred end-around to its input through its associated load select circuit. Simultaneously, each output data word is transferred to buffer register 94, 95, 96 associated with a note shift register 35, 36, 93. The executive control 16 causes a data word in each of the buffer registers to be transferred sequentially to data select 97. The timing sequence of data transfer from buffer registers 94, 95, 96 to data select 97 is shown in FIG. *7a*. The sampling rate for data transfer from any buffer register should be at a frequency $f \times 2 \times s$, where $f$ is the maximum frequency and $s$ is a safety factor to minimize the possibility of aliasing of frequencies. The maximum value shown in Table III using harmonic limiting is 20.930Khz which with a safety factor of $2^{1.37/12} = 1.0823$ indicates a satisfactory sampling timing rate of 46.03Khz for an individual channel.

The data chosen at any sampling time is converted to an analog signal by means of digital-to-analog converter 98. The resulting voltage is directed by data select 99 to one of the sample and hold 100, 101, 102, there being such a device corresponding to each of the note shift registers. The analog signal is maintained at its present amplitude during the time between which an individual buffer register is again caused to transfer its current contents under command from executive control 16. The output signals from all sample and hold circuits are added together in sum 55 and then sent to sound system 11.

Executive control 16 maintains instantaneous information concerning the status of a note's envelope. Thus executive control 16 commands a word to be read from attack/release memory 103 at each data select time which is appropriate to the instantaneous envelope status of the note assigned that particular data select time. The digital words addressed from attack/release memory are converted into analog voltages by means of digital-to-analog converter 104. These analog voltages are applied to digital-to-analog converter 98 so that they control the maximum conversion voltage that can be generated at the current data select time.

An obvious modification to those skilled in the art is to replace the digital attack/release sybsystem consisting of attack/release memory 103 and digital-to-analog converter 104 by a conventional analog envelope generating circuit suitable for a tone synthesizer which generates amplitude control signals.

Figure 8:
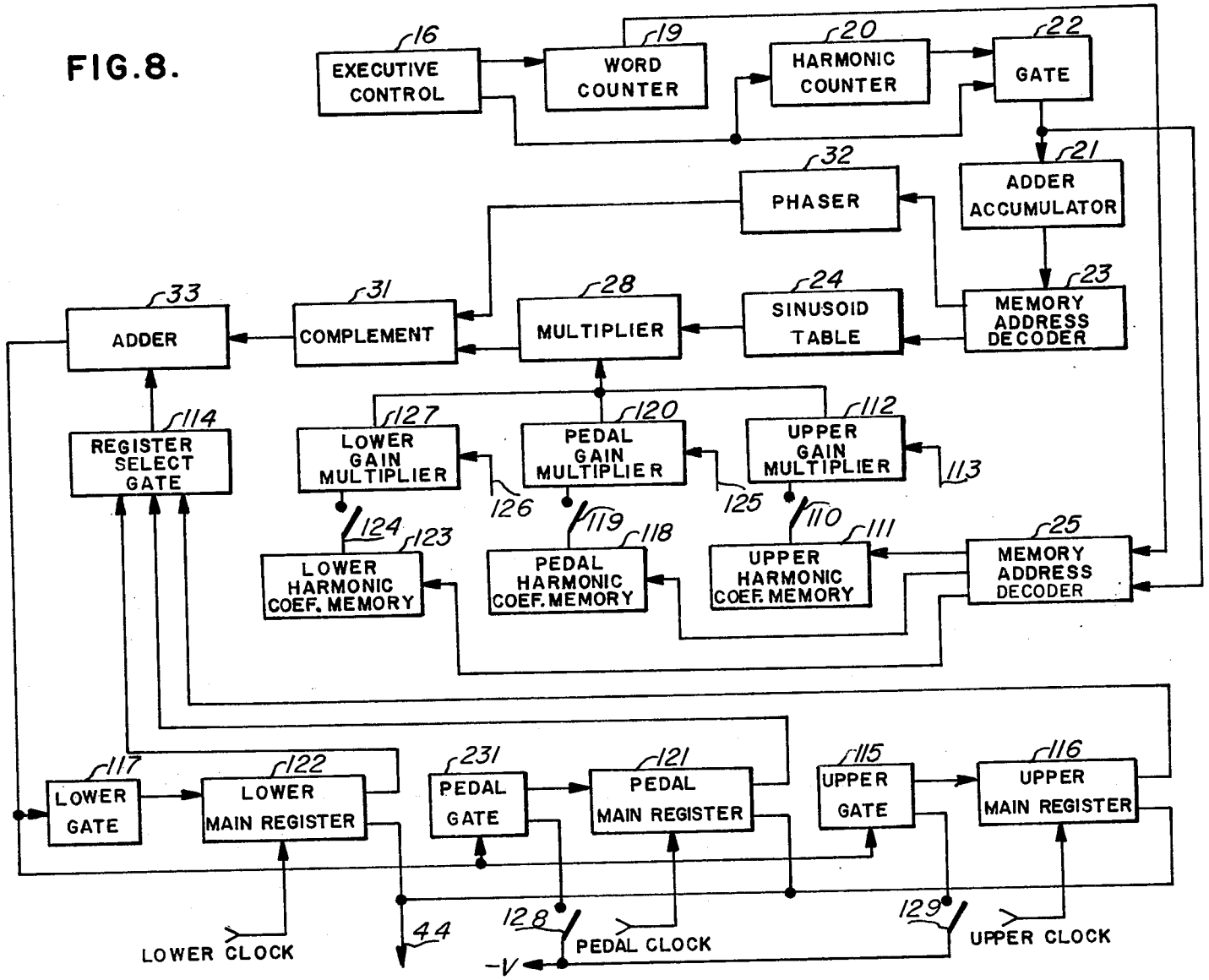
FIG. 8 is a block diagram showing means for division couplers.

FIG. 8 shows a subsystem used in combination with system 10 to provide individual master data sets for a polyphonic tone synthesizer consisting of a plurality of keyboards. Each set of keyboard switches is assigned its own individual tonal sounds, or equivalently each set is assigned its own group of harmonic coefficient memories. It is common terminology to refer to an instrument keyboard and its associated tone generating subsystem as a "division" of the instrument. The subsystem illustrated in FIG. 8 and described below, is for an instrument having an upper, lower and pedal keyboard such as an electronic organ.

The computation cycle for the subsystem shown in FIG. 8 is composed of three major subcycles, each corresponding to the computation of a master data set for each of the three instrument divisions. For explanatory purposes the computing subcycles are called upper, pedal, and lower cycles. During the upper cycle, memory address decoder 25 addresses the contents of upper harmonic coefficient memory 111. If switch 110 is closed, the upper harmonic coefficients are transferred to upper gain multiplier 112. The upper gain multiplier 112 multiplies, or scales, the upper harmonics by a number, usually less than or equal to one. The scale control signal is obtained via line 113. In such fashion the harmonic coefficients magnitudes are adjusted by the player to his individual taste at any time during his performance on the instrument. The output signal from upper gain multiplier 112 is then transmitted as an input signal to multiplier 28. All the logic blocks preceding multiplier 28 perform as described previously with respect to system 10 shown in FIG. 1. Complementer 31 and adder 33 also perform as previously described.

During the upper cycle, upper gate 115 permits a transfer of its input signals while pedal gate 231 and lower gate 117 inhibit their input signals from a transfer of data. Also during the upper cycle, register select gate 114 operates to transfer to adder 33 only data read from upper main register 116. Thus, during the upper cycle, adder 33, upper gate 115, upper main register 116 and register select gate 114 act in combination as an end-around shift register for sequentially adding numbers to the contents of upper main register 116.

The pedal cycle operates in a manner analogous to the upper cycle. During the pedal cycle, pedal harmonic coefficients are read from pedal harmonic coefficient memory 118. The coefficients are modified by pedal gain multiplier 120 from line 125 is switch 119 is closed. Upper gate 115 and lower gate 117 inhibit their input data while pedal gate 231 transfers its input data to pedal main register 121. Register select gate 114 only transfers data from pedal main register while inhibiting data received from the other main registers. Therefore, during the upper cycle the pedal main register is loaded as an end-around combination with adder 33.

The lower cycle operates in a manner analogous to the upper cycle and acts to load lower main register 122.

During the subcycles of the computation cycle, division couplers can be implemented. The division couplers are controlled by switches 128 and 129, called coupler switches. If switch 129 is closed, then the contents of lower main register 122 will be effectively added to the contents of upper main register 116 to accomplish what is called a lower-to-upper division coupler. Thus, keys actuated on the upper division will sound a combination of both the current upper division sound and the current lower division sound. During the lower cycle, closing switch 129 causes upper gate 115 to transfer its input data. Thus, upper main register 116 will be loaded with the identical data loaded into lower main register 122. During the upper cycle, all gates 117, 231, 115 operate in their normal manner. The result is that at the end of the upper cycle, the upper main register contains data which is the sum of that which would be computed from an upper cycle and is added to data word for word with that which was generated during the lower cycle.

Switch 128, when closed, commands a lower-to-pedal division coupler. During the lower cycle, closing switch 128 causes pedal gate 231 to transfer its input data so that pedal main register 121 contains the same data loaded into lower register 122. During pedal cycle, the contents of pedal main register 118 will become the sum of the data in the lower main register and the data normally assigned to pedal main register 118.

While FIG. 8 shows a single main register for each of three instrument divisions, it is an obvious modification to replace each, or any, of these main registers by a multiplicity of registers as shown in FIG. 6 and described previously so that harmonic limiting can be implemented simultaneously with division couplers. It is also an apparent modification that each, or any, of the harmonic coefficient memories shown in FIG. 8 can be replaced by a harmonic register subsystem of the type shown in FIG. 3 and described previously.

Figure 9:
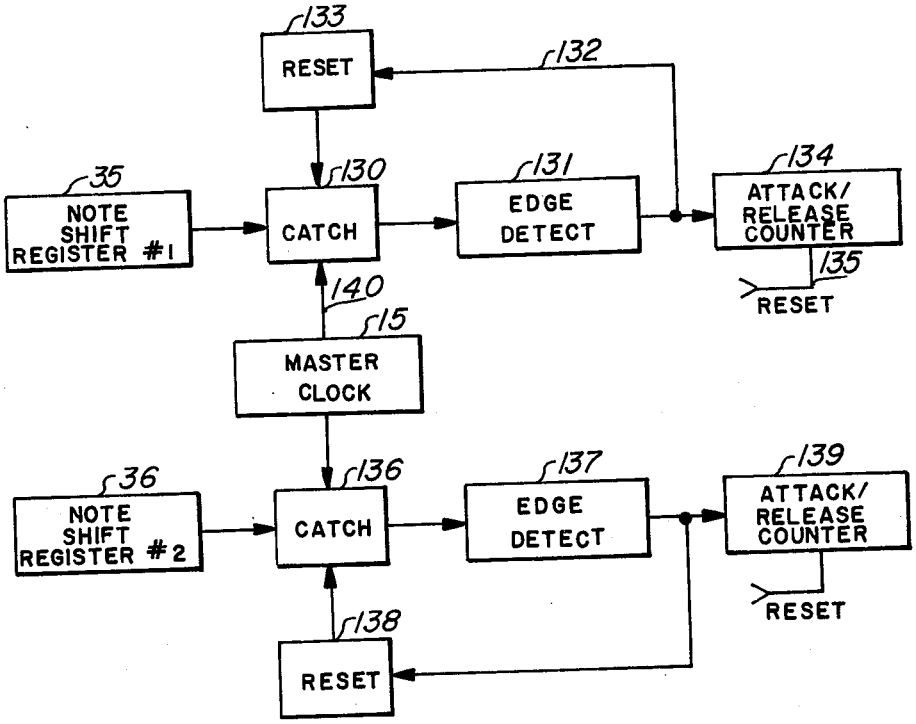
FIG. 9 is a block diagram illustrating synchronizing bit detection and attack/release counters.

FIG. 9 shows some of the details of synchronization bit detector 39 for system 10 shown in FIG. 1, and described previously. Particularly, FIG. 9 shows the manner in which the synchronizing bits from the note shift registers are detected, data converted from asynchronous clocks to common synchronism with master clock 15, and used to control an attack/release memory 103 of the type shown in FIG. 7 and described previously. The operation of the logic blocks shown in FIG. 9 are described for a time following the first load cycle. As described with reference to FIG. 1, the least significant bit of each note register is reserved for a synchronizing bit. Although previously system 10 had been described for note registers having only a single 1 in the least significant bit for the 64 words, an extra 1 bit is now inserted in this bit position for word 33. Thus, a synchronizing bit is circulating for the start of each period of the synthesized tone as well as at each half period. The start bit is used to initiate a loading cycle to maintain waveshape integrity and in conjunction with the half cycle bit is used to furnish timing information for controlling an attack/release envelope generator of the type shown in FIG. 7.

When either a start bit or a half-cycle bit is detected at the time a word is read from note shift register #1 35, this bit is retained in temporary storage by catch 130. An edge detector 131 generates a pulse signal each time that a latch contained within catch 130 is set. The edge detector output signal is sent via line 132 to reset 133. Simultaneously, the same signal is sent to increment an attack/release counter 134. At the initiation of an attack for a note, note detect and assignor 14 (FIG. 1) sends a signal on line 135 to reset attack/release counter 134. When note detect and assignor 14 detects that the corresponding keyboard switch has been released (opened), attack/release counter is again reset so that it counts half-cycles for the release envelope control function. Logic blocks 36, 136, 137, 138, and 139 in FIG. 9 operate in an analogous manner as described for corresponding logic blocks 35, 130, 131, 133, and 134.

Figure 10:
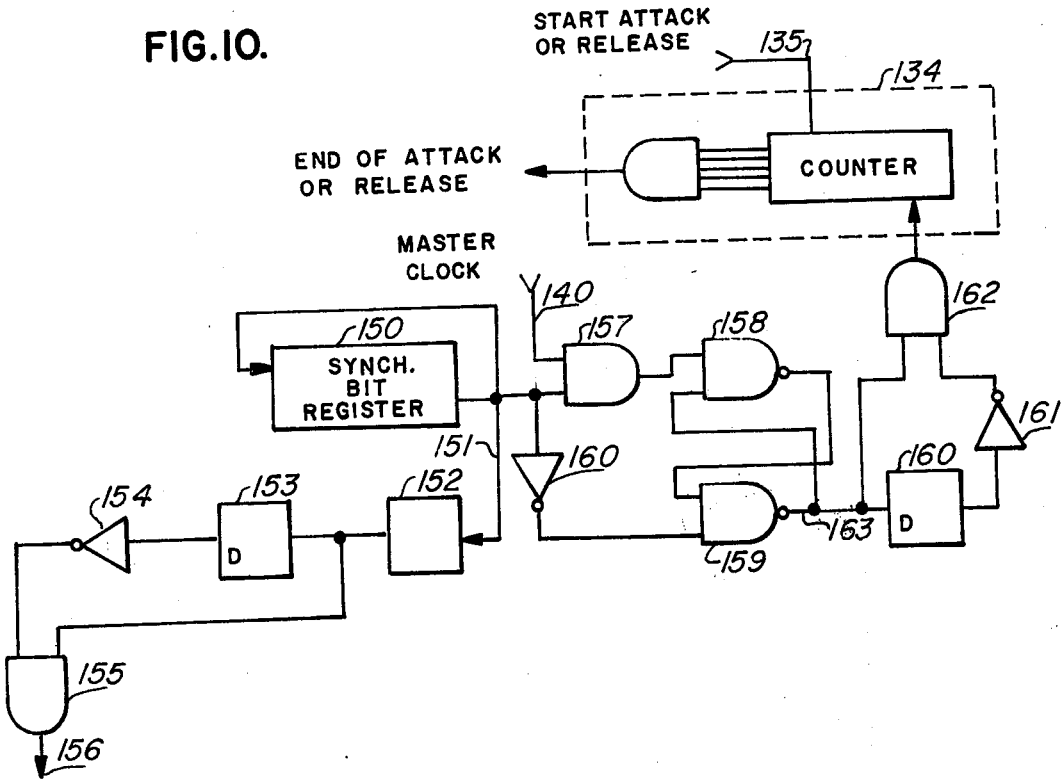
FIG. 10 is a logic diagram showing operation of synchronizing bit detector and note select control signal.

FIG. 10 shows the implementation of FIG. 9 at the logic gate level. Note register 35 of FIG. 9 has been replaced for explanatory reasons by an equivalent 64-one bit word synchronize bit register 150. Each start bit and half-cycle bit read from synchronize bit register 150 is sent via line 151 to toggle flip-flop 152. The combination of a bit delay 153, invertor 154, and AND gate 55 function as an edge detector to output a pulse on line 156 each time that flip-flop 152 is reset. Therefore, the pulse on line 156 signals the start of a cycle for the note shift register corresponding to synchronize bit register 150. The signal on line 156 is used by Synch. bit detector 39 shown in FIG. 1. The combination of AND gate 157, NAND gates 158 and 159 with invertor 160 operates as signal latch. The latch is set at any time such that a start bit or half-cycle bit appears on the output of synchronize bit register 150 and a pulse occurs on line 140 from master clock 15. This latch is reset when the output from the synchronize bit register 150 is 0. The combination of bit delay 160, invertor 161, and AND gate 162 functions as an edge detector to generate a pulse each time that a signal appears on line 163 from the latch. The edge detected signal is used to increment attack/release counter 134.

An obvious modification of system 10 shown in FIG. 1, is to replace the sine functions stored in sinusoid table 24 by cosine functions. When such a substitution is made the master data function is generated by the discrete Fourier series $$Z_N = \sum_{p=1}^{M} c_q \cos(2\pi \frac{Nq}{2M}) + \sum_{q=1}^{M} d_q \cos(2\pi \frac{Nq}{2M}) \quad \text{(Equation 5)}$$

where the parameters have the same range as listed in connection with Equation 1. Since, the cosine trigonometric function has even symmetry with respect to the half-cycle point, complementer 44 of FIG. 1 can be eliminated from system 10.

It is well-known in mathematical art that for a period of a waveshape, such as that used in musical sounds, that generalized harmonic series can be used to represent the waveshape. Such generalized harmonic series include but are not limited to the Fourier series of the types shown in Equation 1 and Equation 5. The generalized harmonic series is written in the form $$Z_n = \sum_q a_q \phi_q(n) \quad \text{(Equation 6)}$$

where $\phi_q(n)$ denotes any of the family of orthogonal functions or orthogonal polynomials. By analogy with conventional Fourier series, the coefficients $a_n$ are called generalized Fourier harmonic coefficients. Frequently Equation 6 is called a discrete generalized Fourier transform. The orthogonal polynomials include Legendre, Gengenbauer, Jacobi, and Hemite polynomials. The orthogonal functions include Walsh, Bessel, and trigonometric. For purposes of language used in claims, the term orthogonal function is used generically to include both orthogonal functions and orthogonal polynomials.

A generic polyphonic tone synthesizer, of which 10 of FIG. 1 is included, can be implemented for any of the orthogonal functions or polynomials by replacing sinusoid table 24 by tables of the values of such orthogonal functions or polynomials. Depending upon the symmetry of the selected functions or polynomials, complementer 31 will be used if an odd symmetry occurs with respect to the mid point or it is eliminated if there is even symmetry. If the selected function or polynomial does not have either even or odd symmetry, complementer 31 is eliminated and main register 34 is expanded to 64 words. For this situation the computation cycle is expanded to intervals of N=1, . . . ,64 in an obvious extension as described with respect to FIG. 1. Moreover, during the load cycle, main register 34 is read in only one direction to transfer its 64 data words.

Figure 11:
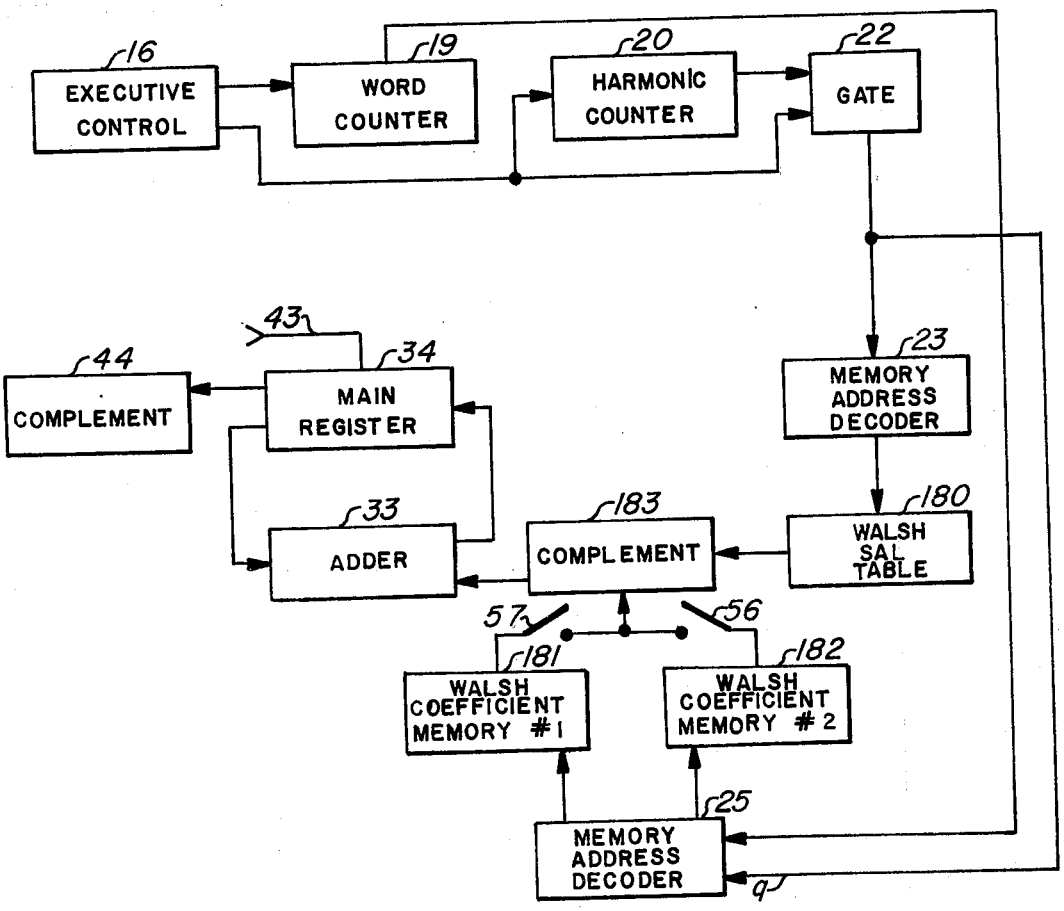
FIG. 11 is a block diagram of polyphonic tone synthesizer using Walsh functions.

The Walsh functions have an attractive characteristic for digital systems in that the amplitudes have only 1 or 0 as possible values. The Walsh function, Wal, can be decomposed into a Sal and Cal function. The Sal function is roughly similar to the trigonometric sine function and like its counterpart has an odd symmetry with respect to its midpoint. The Cal function is roughly similar to the trigonometric cosine function and also has an even symmetry with respect to its midpoint. FIG. 11 shows the portion of system 10 of FIG. 1 that has been modified for operation with Sal functions.

Table IV lists the Sal functions $Sal_q(N)$ for values of the "sequency" (analogous to conventional frequency) $q$ from 1 to 16 and values of N from 1 to 32. The entries for N greater than 32 are obtained by using the odd symmetry property $$Sal_q(N) = -Sal_q(65-N) \quad \text{(Equation 7)}$$

for N in the range of 33 to 64. Table IV is restricted to $q$ less than 17 for brevity, although the operation of the subsystem shown in FIG. 11 is described for $q$ having values from 1 to 32.

TABLE IV

| N | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 | 1 |
| 2 | 1 | 1 | 1 | 1 | 1 | 1 | 1 | 1 | 1 | 1 | 1 | 1 | 1 | 1 | 1 | 1 |
| 3 | 1 | 1 | 1 | 1 | 1 | 1 | 1 | 1 | 0 | 0 | 0 | 0 | 0 | 0 | 0 | 0 |
| 4 | 1 | 1 | 1 | 1 | 1 | 1 | 1 | 1 | 0 | 0 | 0 | 0 | 0 | 0 | 0 | 0 |
| 5 | 1 | 1 | 1 | 1 | 0 | 0 | 0 | 0 | 0 | 0 | 0 | 0 | 1 | 1 | 1 | 1 |
| 6 | 1 | 1 | 1 | 1 | 0 | 0 | 0 | 0 | 0 | 0 | 0 | 0 | 1 | 1 | 1 | 1 |
| 7 | 1 | 1 | 1 | 1 | 0 | 0 | 0 | 0 | 1 | 1 | 1 | 1 | 0 | 0 | 0 | 0 |
| 8 | 1 | 1 | 1 | 1 | 0 | 0 | 0 | 0 | 1 | 1 | 1 | 1 | 0 | 0 | 0 | 0 |
| 9 | 1 | 1 | 0 | 0 | 0 | 0 | 1 | 1 | 1 | 1 | 0 | 0 | 0 | 0 | 1 | 1 |
| 10 | 1 | 1 | 0 | 0 | 0 | 0 | 1 | 1 | 1 | 1 | 0 | 0 | 0 | 0 | 1 | 1 |
| 11 | 1 | 1 | 0 | 0 | 0 | 0 | 1 | 1 | 0 | 0 | 1 | 1 | 1 | 1 | 0 | 0 |
| 12 | 1 | 1 | 0 | 0 | 0 | 0 | 1 | 1 | 0 | 0 | 1 | 1 | 1 | 1 | 0 | 0 |
| 13 | 1 | 1 | 0 | 0 | 1 | 1 | 0 | 0 | 0 | 0 | 1 | 1 | 0 | 0 | 1 | 1 |
| 14 | 1 | 1 | 0 | 0 | 1 | 1 | 0 | 0 | 0 | 0 | 1 | 1 | 0 | 0 | 1 | 1 |
| 15 | 1 | 1 | 0 | 0 | 1 | 1 | 0 | 0 | 1 | 1 | 0 | 0 | 1 | 1 | 0 | 0 |
| 16 | 1 | 1 | 0 | 0 | 1 | 1 | 0 | 0 | 1 | 1 | 0 | 0 | 1 | 1 | 0 | 0 |
| 17 | 1 | 0 | 0 | 1 | 1 | 0 | 0 | 1 | 1 | 0 | 0 | 1 | 1 | 0 | 0 | 1 |
| 18 | 1 | 0 | 0 | 1 | 1 | 0 | 0 | 1 | 1 | 0 | 0 | 1 | 1 | 0 | 0 | 1 |
| 19 | 1 | 0 | 0 | 1 | 1 | 0 | 0 | 1 | 0 | 1 | 1 | 0 | 0 | 1 | 1 | 0 |
| 20 | 1 | 0 | 0 | 1 | 1 | 0 | 0 | 1 | 0 | 1 | 1 | 0 | 0 | 1 | 1 | 0 |
| 21 | 1 | 0 | 0 | 1 | 0 | 1 | 1 | 0 | 0 | 1 | 1 | 0 | 1 | 0 | 0 | 1 |
| 22 | 1 | 0 | 0 | 1 | 0 | 1 | 1 | 0 | 0 | 1 | 1 | 0 | 1 | 0 | 0 | 1 |
| 23 | 1 | 0 | 0 | 1 | 0 | 1 | 1 | 0 | 1 | 0 | 0 | 1 | 0 | 1 | 1 | 0 |
| 24 | 1 | 0 | 0 | 1 | 0 | 1 | 1 | 0 | 1 | 0 | 0 | 1 | 0 | 1 | 1 | 0 |
| 25 | 1 | 0 | 1 | 0 | 0 | 1 | 0 | 1 | 1 | 0 | 1 | 0 | 0 | 1 | 0 | 1 |
| 26 | 1 | 0 | 1 | 0 | 0 | 1 | 0 | 1 | 1 | 0 | 1 | 0 | 0 | 1 | 0 | 1 |
| 27 | 1 | 0 | 1 | 0 | 0 | 1 | 0 | 1 | 0 | 1 | 0 | 1 | 1 | 0 | 1 | 0 |
| 28 | 1 | 0 | 1 | 0 | 0 | 1 | 0 | 1 | 0 | 1 | 0 | 1 | 1 | 0 | 1 | 0 |
| 29 | 1 | 0 | 1 | 0 | 1 | 0 | 1 | 0 | 0 | 1 | 0 | 1 | 0 | 1 | 0 | 1 |
| 30 | 1 | 0 | 1 | 0 | 1 | 0 | 1 | 0 | 0 | 1 | 0 | 1 | 0 | 1 | 0 | 1 |
| 31 | 1 | 0 | 1 | 0 | 1 | 0 | 1 | 0 | 1 | 0 | 1 | 0 | 1 | 0 | 1 | 0 |
| 32 | 1 | 0 | 1 | 0 | 1 | 0 | 1 | 0 | 1 | 0 | 1 | 0 | 1 | 0 | 1 | 0 |
| 33 | 0 | 1 | 0 | 1 | 0 | 1 | 0 | 1 | 0 | 1 | 0 | 1 | 0 | 1 | 0 | 1 |

Table V lists both the conventional Fourier coefficients (trigonometric functions) and the Sal-Walsh coefficients for a waveshape consisting of a single sinusoid and a waveshape which is a sinusoid having one half the period of the first sinusoid.

In FIG. 11, the operation of logic blocks 16, 19, 20, 22, 23, 25, 33, 34, and 44 are the same as described previously for system 10 shown in FIG. 1. The Walsh SAL Table 180 replaces sinusoid table 24 of FIG. 1 and is addressed in the same fashion during a computation cycle. Memory address decoder 25 causes Walsh coefficients to be read from Walsh coefficient memories 181 and 182 at the appropriate time during a computation function. Instead of multiplier 28, the Walsh function system utilizes a complementer 183. Since, at every bit time the sal function is either a 1 or 0, the required effective multiplication consists of either transferring a Walsh coefficient unchanged if a 1 has been addressed from the Walsh SAL table 180, or by complementing the Walsh coefficient if a 0 has been addressed from this table.

It is apparent that the various subsystems already described in combination with system 10 as shown in FIG. 1 are equally applicable to system 10 wherein the sinusoid table is replaced by a table of generalized harmonic functions such as the Walsh-Sal functions and the harmonic coefficient memories are replaced by generalized harmonic coefficient memories.

TABLE V

| q | Fourier Coef. | Sal-Walsh Coef. | Fourier Coef. | Walsh Coef. |
|---|---|---|---|---|
| A. Single Sinusoid | | | B. 2'nd Harmonic Sinusoid | |
| 1 | 63 | 40.0851 | 0 | 0.0406 |
| 2 | 0 | 0.1171 | 63 | 40.3554 |
| 3 | 0 | −16.8030 | 0 | −0.2160 |
| 4 | 0 | −0.0762 | 0 | −0.0762 |
| 5 | 0 | −3.4144 | 0 | −0.1150 |
| 6 | 0 | −0.0064 | 0 | −16.6737 |
| 7 | 0 | −7.9651 | 0 | 0.0002 |
| 8 | 0 | −0.1409 | 0 | −0.1409 |
| 9 | 0 | −0.6137 | 0 | 0.1709 |
| 10 | 0 | −0.2439 | 0 | −3.5592 |
| 11 | 0 | 0.3078 | 0 | −0.0172 |
| 12 | 0 | 0.1841 | 0 | 0.1841 |
| 13 | 0 | −1.5416 | 0 | 0.0920 |
| 14 | 0 | −0.0783 | 0 | −8.0822 |
| 15 | 0 | −4.1875 | 0 | −0.2435 |
| 16 | 0 | 0.1992 | 0 | 0.1992 |

Figure 12:
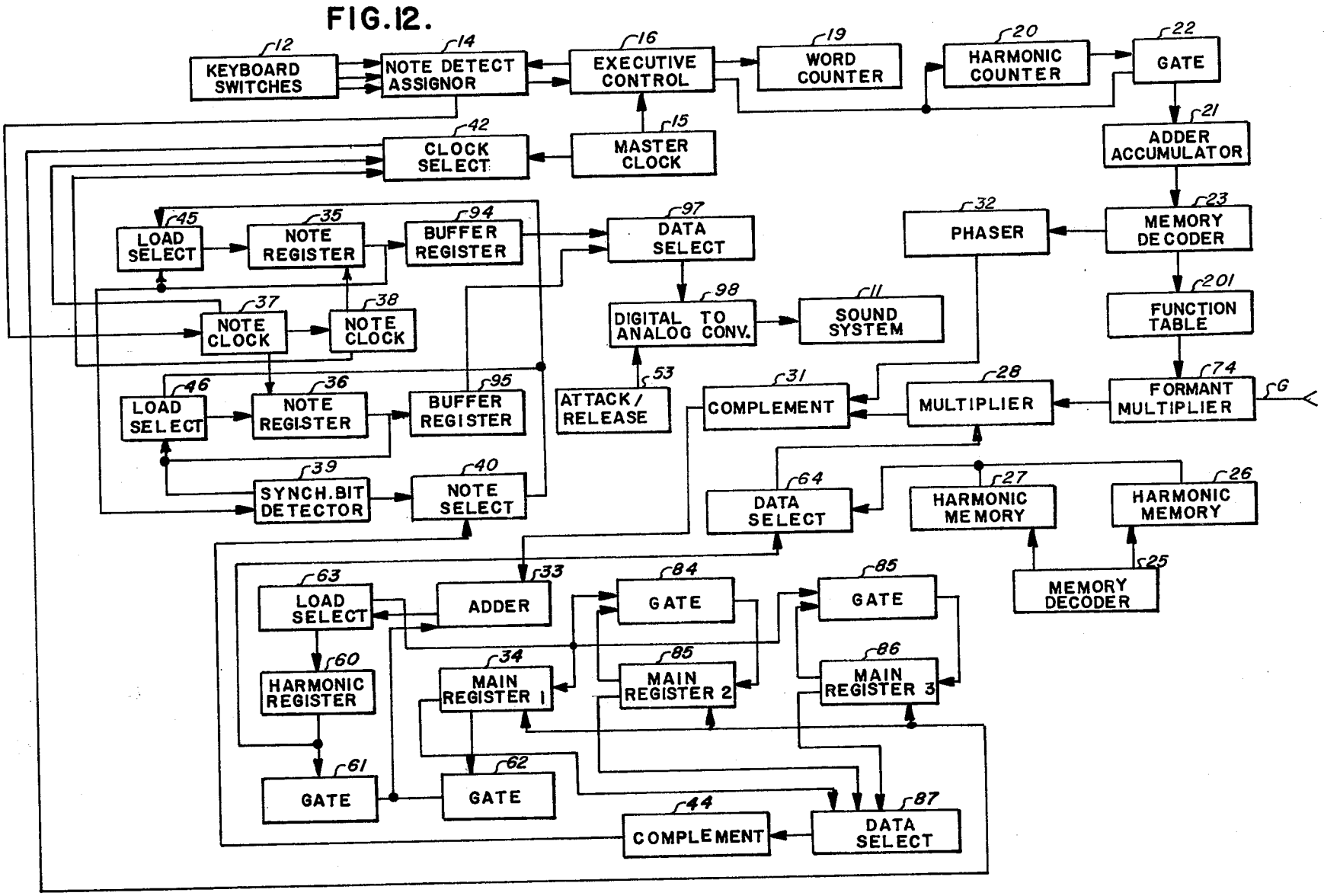
FIG. 12 is a block diagram of polyphonic tone synthesizer in accordance with present invention.

FIG. 12 shows the principle system logic blocks for a polyphonic synthesizer containing the basic system 10 in conjunction with formant filters, harmonic register, harmonic limiting and time-shared output data channels. Function Table 201 is a table of generalized harmonic functions.

While a digital mechanization has been described, this is not necessary; all the system functions could be carried out in analog form. The various shift registers being substituted by analog units such as "bucket brigade" charge-coupled devices.

The invention is not limited to the use of asynchronous clocks for the note clocks, it is an apparent modification to use clocks derived synchronously from master clock 15.

Intending to claim all novel, useful and unobvious features shown or described, the applicants make the following claims:

1. A musical instrument comprising;

means for computing a master data set during each computation cycle of a sequence of computation cycles, a first memory means for writing said master data set to be thereafter read out, a second memory means for writing input information to be thereafter read out, means for reading said master data set from first memory means and writing master data set as input information in said second memory means, means for repetitiously reading out information from second memory means, and means for producing musical waveshapes from said read out information from second memory means.

2. A musical instrument according to claim 1 wherein such means for computing said master data set comprises;

a coefficient memory storing a set of harmonic coefficients each specifying the relative amplitude of a respective one of a set of sinusoidal harmonic components which constitute said master data set, means, operative during each computation cycle, for separately evaluating each of said harmonic components by multiplying the coefficient value for that harmonic component, accessed from said memory, by a sinusoid value associated with that component at each word of said master data set, the argument of said sinusoid value being the product of a number designating said word of master data set times the order of said harmonic component, means for accumulating said evaluated harmonic components to obtain said master data set for each word thereof, and means for writing said master data set words in first memory means.

3. A musical instrument according to claim 2 further comprising;

word counter means for selecting a number indicative of word in said master data set, harmonic counter means for selecting order number of harmonic components, an adder-accumulator means, operative each successive computation time interval, to add said order number to the sum previously contained in said adder-accumulator, the resulting contents of said adder-accumulator representing said argument of said sinusoid value, and means for obtaining said sinusoid values in response to the contents of said adder-accumulator means, said sinusoid values being provided to said means for evaluating.

4. A musical instrument according to claim 3 wherein said means for obtaining comprises;

an adder-accumulator means, cleared each time whereat said word counter means is reset to first number of word in said master data set, and operative during each computation time interval repeatedly to add contents of said harmonic counter means to the sum previously in said adder-accumulator means, the contents of said adder-accumulator representing said arguments, a sinusoid table memory, and sinusoid table accessing means for accessing from said sinusoid table memory the sinusoid values corresponding to the arguments developed in said adder-accumulator means.

5. A musical instrument according to claim 1 wherein said means for reading information from first memory means comprises;

a clock select means for reading master data set from first memory means at a selected rate, a synchronizing time data word stored in second memory means, means for determining phase time wherein said synchronizing time data word is read from second memory means, means responsive to phase time whereby said clock select causes contents from first memory means to be read out at said selected rate and caused to be written into second memory means, and means for determining finish of said writing into second memory means and thereupon causing said clock select means to end reading from first memory means.

6. A musical instrument according to claim 1 wherein such computing is done digitally and wherein said means for producing musical waveshapes comprising;

a sound system, a digital-to-analog convertor receiving said information read from second memory means and providing an analog output signal having a musical waveshape corresponding to said information, envelope generating means for modulating said analog signal of the musical waveshape to effectuate attack and release, and amplifier means for providing said modulated analog signal to said sound system.

7. A musical instrument comprising;

a first memory means for writing master data set to be thereafter read out, wherein number N designates the address of words in said first memory means, means to set contents of first memory means to zero values at start of computation cycle, first means for computing numbers Z(N) in master data set in accordance with the relation $$Z(N) = \sum_{q=1}^{W} c_q \sin(2\pi \frac{Nq}{2W})$$

where $q=1,2,3, \ldots W$, $N=1,2, \ldots, W$ and W is the number of harmonic components defining said number Z(N) in said master data set, and $c_q$ is the harmonic coefficient of the corresponding $q^{th}$ harmonic component, said first means comprising;

a memory storing said harmonic coefficients $c_q$, a sinusoid table comprising a memory storing values of $\sin(\pi\phi/W)$ for $0 \leqq \phi \leqq 2W$ at intervals of D where D is a resolution constant, harmonic component evaluation circuitry utilizing said memory and said sinusoid table to calculate $c_q \sin(\pi Nq/W)$ for each of the W harmonic components in accordance with a selected value of N, means for successively algebraically summing output $c_q \sin(\pi Nq/W)$ of said harmonic component evaluation circuitry with values of word N written in first memory means, second memory means for storing a master data set to be thereafter read out, second means responsive to first means for transferring said master data set from first memory means to second memory means, means for converting a master data set to a musical waveshape, and third means responsive to said second means for repetitively reading out the words of said master data set from second memory means and providing said read out words to said means for converting.

8. A musical instrument according to claim 7 wherein said harmonic component evaluation circuitry comprises;

a word counter incremented at each computation time in said computation cycle wherein said word counter is modulo W, the contents of said word counter thereby represents said number N, modulo W reset circuitry whereby a reset signal is created when said word counter is reset when content N equals W, a harmonic counter incremented by said reset signal wherein said harmonic counter is modulo W and contains the harmonic number q, an adder-accumulator for adding successive values of content q of said harmonic counter wherein said adder-accumulator is cleared to zero by said reset signal, the contents of said adder-accumulator thereby representing Nq, a first memory address decoder for addressing said sinusoid table in response to the value Nq contained in said adder-accumulator, to access from said sinusoid table the corresponding stored value $\sin(2\pi Nq/W)$, and a multiplier means for multiplying each such addressed term $\sin(2\pi NqW)$ by the harmonic coefficient $c_q$ for the corresponding $q^{th}$ harmonic component, the products of such multiplication being supplied to said means for successively algebraically summing.

9. A musical instrument according to claim 8 wherein means for successively algebraically summing means comprises;

a phase constant means responsive to said harmonic number q, wherein a phase control signal is created corresponding to each value of said harmonic number, a first complementer means wherein products supplied from said multiplier means are altered in algebraic sign responsive to said phase control signal, first memory addressing means responsive to number N in said word counter whereby contents addressed in said first memory means are read out, and an adder for algebraically summing said products supplied from said multiplier which are altered in algebraic sign by said first complementer means and contents read out from said first memory means, the summed values being stored in first memory means.

10. A musical instrument according to claim 9 wherein means responsive to first means for transferring said master data set from said first memory means to said second memory means during load cycle time interval conprises;

means for storing synchronizing signal in contents of said second memory means, means for detecting presence of said synchronizing signal in contents read from said second memory means and whereby a phase time signal is created, clock select means for selecting a member of plurality of note clock pulse rates responsive to closure of keyboard switches, second memory address decoder means comprising an up-down counter, cleared when said phase time signal is created, said counter being incremented by said selected member of note clock rates and providing said counter contents to said first memory addressing means whereby contents of said first memory are read out at said selected member of note of clock rates; said up-down counter contents being successively incremented from 1 to N and subsequently incremented from N to 1 in reverse order, second complement means wherein contents read out of said first memory are provided to memory loading means unchanged for reading words 1 to N and subsequently wherein contents read out of said first memory are provided to memory means altered in algebraic sign for reading words N to 1 in reverse order, memory loading means for storing contents of said first memory as provided by said second complement means in said second memory means.

11. A musical instrument according to claim 10 wherein second memory means comprises;

first and second memories for writing input from said memory loading means to be thereafter read out, means for storing synchronizing signal in contents of said first and second memories, means for detecting presence of said synchronizing signal in contents read from said first and second memories and whereby a phase time signal is created, note select means responsive to said phase time signal creation whereby said memory loading means is caused to store contents of said first memory as provided by said second complement means into selected said first memory or into selected said second memory, and third address decoder means for causing contents of said first and second memories to be read at rates responsive to closure of said keyboard switches.

12. A musical instrument according to claim 11 wherein said third means comprises;

first and second note clocks having adjustable rates, assignor means comprising circuitry for adjusting rates of said first and second note clocks responsive to closure of said keyboard switches, means for causing said first and second note clocks to read out contents of said first and second memories, and a first and second convertor respectively receiving contents read from said first and second memories and providing analog musical waveshapes corresponding to said contents.

13. A musical instrument according to claim 7 wherein said first memory means, said memory, said sinusoid table, and said second memory means are digital devices in which said coefficients and values are stored in digital form, wherein said first means for computing functions digitally, and wherein said third means comprises a digital-to-analog converter.

14. A musical instrument according to claim 12 wherein note selection is accomplished by assignor means comprising;

means for detecting closure of said keyboard switches and generating corresponding detection signals, means for associating said detection signals with musical notes, and further comprising circuitry for assigning said first and second note clocks to said closed keyboard switches and for adjusting rates of said clocks to frequencies 2N times that of said musical notes, means for detecting opening of said keyboard switches and thereupon generating a release signal, and circuitry responsive to said release signal to cause corresponding said first or second note clocks to be inhibited thereby terminating read out of contents of corresponding first or second memory.

15. A musical instrument according to claim 7 wherein said first means comprises;

first and second harmonic coefficient memories respectively storing different sets of harmonic coefficients selected to produce notes of first and second tonal quality, and first and second stop switches for selecting respectively whether said first or second harmonic coefficient memory or combination is used by said harmonic evaluation circuitry for computing numbers in said master data set.

16. A musical instrument comprising;

a first memory means for writing master data set to be thereafter read out, wherein number N designates address of words in said first memory means, means to set contents of first memory means to zero values at start of computation cycle, first means for computing numbers y(N) in said master data set in accordance with the relation for a discrete generalized Fourier transform $$y(N) = \sum_{q=1}^{M} a_q \phi_q(N)$$

where $q=1,2, \ldots ,M$, $N=1,2, \ldots ,M$ and M is the number of a generalized harmonic coefficient of the corresponding generalized $q^{th}$ component, said first means comprising a harmonic memory means storing said generalized coefficients $a_q$, a function table comprising a memory storing values of orthogonal function $\phi_q(ND)$, where D is a resolution constant generalized harmonic component evaluation circuitry utilizing said harmonic memory means and said function table to calculate $a_q\phi_q(N)$ for each of the M generalized harmonic components in accordance with a selected value of N, a means for successively algebraically summing output of said generalized harmonic component evaluation circuitry with contents of word N in first memory means, second memory means for storing a master data set to be thereafter read out, second means responsive to first means for transferring said master data set from first memory means to second memory means, means for converting a master data set to a musical waveshape, and third means responsive to said second means for repetitively reading out the words of said master data set from second memory means and providing said read out words to said means for converting.

17. A musical instrument according to claim 16 wherein said generalized harmonic component evaluation circuitry comprises;

a word counter incremented at each computation time in said computation cycle wherein said word counter is modulo M, the contents of said word counter thereby represents said number N, modulo M reset circuitry whereby a reset signal is created when said word counter is reset when content N equals M, a harmonic counter incremented by said reset signal wherein harmonic counter is modulo M and contains the generalized harmonic number $q$, a first memory address decoder for addressing said function table in response to value N in said word counter and value $q$ in said harmonic counter to access from function table the corresponding stored value $\phi_q(N)$, and a multiplier means for multiplying each such addressed term $\phi_q(N)$ by said generalized harmonic coefficient $a_q$ for the corresponding $q^{th}$ generalized harmonic component, the products of such multiplication being supplied to said means for successively algebraically summing.

18. A musical instrument according to claim 17 wherein said orthogonal functions are Walsh functions and said generalized harmonic coefficients are Walsh coefficients and said multiplier means comprises a complementer for altering the algebraic sign of said Walsh coefficients if the corresponding Walsh function has value 0 and said complementer does not alter said algebraic sign if Walsh function has value 1.

19. A musical instrument according to claim 17 wherein harmonic memory means comprises;

first and second harmonic memories storing different sets of generalized harmonic coefficients selected to produce note of first and second tonal quality, first and second stop switches for selecting combinations of said first and second harmonic memories utilized by said generalized harmonic component evaluation circuitry, third harmonic memory means for writing data to be thereafter read out, and load select means whereby output from said generalized harmonic component evaluation circuitry selectively reads into said third harmonic memory means or reads into said first memory means.

20. A musical instrument according to claim 19 wherein computation cycle comprises;

a first and second time interval, wherein during first time interval said harmonic counter is caused to increment consonant with said word counter at each computation time, said first memory address decoder is caused to consecutively address maximum value stored in said function table, said means for algebraically summing provides data to said load select means which is caused to read into said third harmonic memory means; and wherein during said second time interval said harmonic counter is caused to increment by said reset signal, said first memory address decoder is caused to address said function table in response to value N in said word counter and value $q$ in said harmonic counter, and said load select means is caused to read into said first memory means.

21. A musical instrument according to claim 8 further comprising;

coefficient memory means storing a set of formant coefficients $G_j$, $j=1,2,\ldots,H$; where H is number of said formant coefficients, formant clock providing timing signals, comparator means responsive to said timing signals providing address signal to said coefficient memory means, multiplier means comprising first and second multiplier whereby first multiplier multiplies each said addressed term $\sin(2\pi Nq/W)$ by formant coefficient $G_j$ addressed from said coefficient memory and such products provided to said second multiplier, whereby second multiplier multiplying each term provided from said first multiplier by the harmonic coefficient $c_q$ for the corresponding $q^{th}$ harmonic component, the products $G_j c_q \sin(2\pi Nq/W)$ of such multiplication being supplied to said means for algebraically adding.

22. A musical instrument according to claim 21 wherein said coefficient memory means comprises circuitry for computing values of said formant coefficients responsive to signals provided from said comparator means.

23. A musical instrument according to claim 21 wherein formant clock comprises means for generating said timing signals responsive to envelope of corresponding said musical note.

24. A musical instrument according to claim 17 wherein means for successively algebraically summing comprises;

first and second data memory means, first memory addressing means responsive to number N in said word counter whereby contents in first and second data memory means are simultaneously addressed for read out and storage, an adder for algebraically summing said products supplied from said multiplier means and contents read from said first data memory means and such summed values are provided to said first memory addressing means whereby summed values are stored in said first data memory means, a gating means whereby for values of $q$ in said harmonic counter less than number Q, said summed values are caused by said first memory addressing means to be stored in said second data memory means, and whereby for said values of $q$ equal to or exceeding said number Q, said first memory addressing means causes contents read from said second data memory means to be stored without alteration in second data memory means, and first data select means whereby data read from said first and second data memory means may be selected.

25. A musical instrument according to claim 11 wherein said third means comprises;

first and second note clocks having adjustable rates, assignor means comprising circuitry for adjusting rates of said first and second note clocks responsive to closure of said keyboard switches, means for causing said first and second note clocks to read out contents of said first and second memories, first and second buffer means whereby data read from said first memory is retained in first buffer means to be thereafter read out and whereby data read from said second memory is retained in second buffer means to be thereafter read out, means for repetitively successively reading out contents from said first and second buffer means, conversion means receiving contents read from said first and second buffer means and providing corresponding analog signals responsive to said contents, said analog signals moreover being of variable amplitude responsive to amplitude control signals provided to said conversion means, data select means comprising first and second holding circuitry for retaining said analog signals to be thereafter read out whereby said analog signal corresponding to contents read from first buffer means is retained in said first holding circuitry and said analog signal corresponding to contents read from second buffer means is retained in said second holding circuitry, and summing means whereby said analog signals retained in said first and second hold circuitry are repetitively read out and summed.

26. A musical instrument according to claim 16 wherein said first means comprises;

first and second generalized harmonic coefficient memories respectively storing different sets of generalized harmonic coefficients selected to produce notes of first and second tonal quality, first and second stop switches for selecting respectively whether said first or second generalized harmonic coefficient memory or combination is used by said harmonic evaluation circuitry for computing numbers in said master data set, and first and second gain means whereby data read from said first generalized harmonic coefficient memory is scaled by first gain means responsive to first scale control signal and whereby data read from said second generalized harmonic coefficient memory is scaled by second gain means responsive to second scale control signal.

27. A musical instrument according to claim 17 wherein means for algebraically summing means comprises;

a phase constant means responsive to said generalized harmonic number *q*, wherein a phase control signal is created corresponding to each value of said harmonic number, a first complementer means wherein products supplied from said multiplier means are altered in algebraic sign responsive to said phase control signal, first memory addressing means responsive to number N in said word counter whereby contents addressed in said first memory means are read out, and an adder for algebraically summing said products supplied from said multiplier which are altered in algebraic sign by said first complementer means and contents read out from first memory means, the summed values being stored in first memory means.

28. A musical instrument according to claim 17 wherein means for successively algebraically summing comprises;

first and second combined data memory means, first and second data gates whereby input data to said first and second combined data memory means are inhibited in response to signals selected by first and second coupler switches, an adder for algebraically summing said products supplied from said multiplier and contents read from said first and second combined data memory means selectable by said first and second data gates whereby said summed signals are stored in said first and second combined data memory means selectable by said first and second data gates, and whereby, said first memory addressing means causes said first and second data gates to: first, read and provide data from said first combined data memory means to adder and subsequently causing said summed signals to be stored in both said first and second combined data memory means and second, read out and provide data from said second combined data memory means to adder and subsequently causing said summed signals to be stored in said second combined data memory means.

29. A musical instrument comprising;

means for computing during a computation cycle a master data set corresponding to the values of a series of points defining a musical waveform, first memory means for storing said master data set generated by said means for computing, second memory means for storing input information to be thereafter read out, means for transferring the data set from said first memory means to said second memory means during a transfer cycle, means for repetitiously reading out the data set from said second memory means at any selected one of a plurality of different rates, and means for producing musical sound from said data set read out from said second memory means.

30. A musical instrument according to claim 29 wherein said means for computing comprises;

means for generating said master data set having words corresponding to points on the sound waveforms during a plurality of successive computation time intervals of said computation cycle, means for calculating a complete set of data for each harmonic component during each computation time interval, accumulator means for adding corresponding words of successively calculated data sets to form the master data set at the completion of the computation cycle, and means for storing the master data set in said first memory means.

31. A digital polyphonic tone synthesizer comprising;

a keyboard comprising a plurality of key switches, a plurality of tone switches wherein each setting of the tone switches corresponds to a selection of a predetermined sound waveshape, digital computing means responsive to setting of said tone switches for generating and storing a master data set having words corresponding to a succession of points on said selected sound waveshape, a plurality of registers, transferring means responsive to the setting of any said key switches whereby said master data set is transferred from said digital computing means to selected members of said plurality of registers, a plurality of variable frequency clock generators each associated with a member of said plurality of registers whereby associated registers are shifted at a selected clock rate, means responsive to operation of any member of said plurality of key switches for setting the frequencies of said clock generators to predetermined values assigned to key switches, digital-to-analog convertor means coupled to said plurality of registers, and means for repeatedly shifting stored master data set in each member of said plurality of registers serially to said digital-to-analog convertor means in synchronism with said associated clock generator, whereby digital-to-analog convertor means generates a plurality of analog output signals each having a fundamental frequency determined by a selected key on said keyboard and a waveshape determined by the setting of said stop switches.

32. A digital polyphonic tone synthesizer according to claim 31 wherein said keyboard further comprises;

a plurality of keyboards each keyboard comprising a plurality of key switches, and a plurality of groups of stop switches wherein each group is associated with one of said keyboards and wherein each group comprises a plurality of tone setting stop switches.

33. A digital polyphonic tone synthesizer according to claim 32 wherein said digital computing means further comprises;

means for independently generating and storing a master data set corresponding to each group of said plurality of groups of stop switches, a plurality of groups of registers, and transfer means responsive to setting of said key switches further comprising means for transferring a selected master data set to selected registers within group of registers corresponding to selected keyboard and selected group of stop switches.

34. In a digital polyphonic tone synthesizer according to claim 31 wherein said plurality of registers comprises;

circuitry whereby a synchronizing word is caused to be stored in each member of plurality of registers, synchronize detection means whereby a detection signal is created in response to synchronizing words read out from said plurality of registers, and transferring means further comprising circuitry responsive to said detection signal thereby causing transfer of said master data set of said plurality of registers.

35. In a digital polyphonic tone synthesizer according to claim 33 wherein said digital computing means further comprises;

a plurality of harmonic coefficient memories associated with corresponding members of said plurality of groups of stop switches, and a plurality of gain multiplier means associated with corresponding members of said plurality of harmonic coefficient memories whereby value of harmonic coefficients read out from harmonic coefficient memories are multiplied by selected numbers.

36. In a digital polyphonic tone synthesizer according to claim 33 wherein said means for independently generating and storing a master data set further comprises;

a plurality of coupler switches, and selection data means responsive to said plurality of coupler switches whereby corresponding words constituting selected master data sets are caused to be algebraically summed.

* * * * *